US008191298B2

(12) United States Patent
Cash et al.

(10) Patent No.: US 8,191,298 B2
(45) Date of Patent: Jun. 5, 2012

(54) MAGAZINE QUICK-RELEASE BLOCKING APPARATUS AND METHOD

(75) Inventors: Robert Keith Cash, Knoxville, TN (US); Daniel James Brown, Knoxville, TN (US)

(73) Assignee: Tomas Quis, Vestin (CZ)

( * ) Notice: Subject to any disclaimer, the term of this patent is extended or adjusted under 35 U.S.C. 154(b) by 235 days.

(21) Appl. No.: 12/605,790

(22) Filed: Oct. 26, 2009

(65) Prior Publication Data

US 2011/0010977 A1 Jan. 20, 2011

Related U.S. Application Data

(60) Provisional application No. 61/226,083, filed on Jul. 16, 2009.

(51) Int. Cl.
*F41A 9/61* (2006.01)
*F41A 3/00* (2006.01)

(52) U.S. Cl. ..... 42/50; 42/49.02; 42/70.02

(58) Field of Classification Search ..... 42/17–18, 42/21–22, 33, 35, 6, 7, 49.01, 49.02, 50, 42/70.02

See application file for complete search history.

(56) References Cited

U.S. PATENT DOCUMENTS

| | | | | |
|---|---|---|---|---|
| 3,019,542 | A * | 2/1962 | Manthos | 42/18 |
| 3,371,440 | A | 3/1968 | Cassell | |
| 3,415,000 | A | 12/1968 | Koucky et al. | |
| 3,562,944 | A | 2/1971 | Wagner et al. | |
| 3,715,826 | A | 2/1973 | Seifried | |
| 3,803,739 | A | 4/1974 | Haines et al. | |
| 4,139,958 | A | 2/1979 | Foote | |
| 4,681,020 | A | 7/1987 | Polanecky | |
| 5,416,998 | A | 5/1995 | Martel | |
| 5,581,926 | A | 12/1996 | Taalib-din et al. | |
| 5,588,241 | A | 12/1996 | Hurley | |
| 5,685,101 | A | 11/1997 | Ferretti | |
| 5,806,224 | A | 9/1998 | Hager | |
| 5,974,717 | A | 11/1999 | Brooks | |
| 7,117,622 | B2 | 10/2006 | Freed et al. | |
| 7,240,449 | B2 | 7/2007 | Clifton, Jr. | |
| 7,373,868 | B2 * | 5/2008 | Quis | 89/128 |
| 7,451,682 | B2 | 11/2008 | Quis | |
| 7,543,403 | B1 | 6/2009 | Schaefer | |
| 7,676,974 | B2 * | 3/2010 | Zemanek | 42/69.02 |
| 7,895,933 | B2 * | 3/2011 | Quis | 89/139 |
| 2005/0011097 | A1 | 1/2005 | Freed et al. | |
| 2005/0257412 | A1 * | 11/2005 | Quis | 42/71.01 |
| 2007/0079696 | A1 * | 4/2007 | Quis | 89/148 |
| 2007/0180748 | A1 | 8/2007 | Zemanek | |
| 2008/0086926 | A1 * | 4/2008 | Quis | 42/17 |
| 2008/0134873 | A1 * | 6/2008 | Quis | 89/139 |
| 2009/0000171 | A1 * | 1/2009 | Quis | 42/18 |
| 2009/0000172 | A1 * | 1/2009 | Quis | 42/69.01 |

FOREIGN PATENT DOCUMENTS

| | | |
|---|---|---|
| WO | 97/00418 | 1/1997 |

* cited by examiner

*Primary Examiner* — Michael David

(74) *Attorney, Agent, or Firm* — Luedeka Neely Group, P.C.

(57) ABSTRACT

Apparatuses, methods, and kits are disclosed for preventing quick release of a magazine from a magazine well of a Sa vzor 58 rifle without the need to substantially disassemble the rifle, thereby providing a means to modify Sa vzor 58 rifles to bring such rifles within permissible limitations of certain local, state, and federal guns laws.

7 Claims, 26 Drawing Sheets

MAGAZINE QUICK-RELEASE BLOCKING APPARATUS AND METHOD

CROSS-REFERENCE(S) TO RELATED APPLICATION(S)

This application is a nonprovisional utility application claiming priority to U.S. Provisional Application Ser. No. 61/226,083 entitled "Magazine Quick-Release Blocking Apparatus and Method" to Robert Keith Cash and Daniel James Brown, the content of which is incorporated herein by reference in its entirety.

STATEMENT REGARDING NOTICE OF COPYRIGHT

A portion of the disclosure of this patent document contains material which is subject to copyright protection under Title 17 of the United States Code. The copyright owner(s) has no objection to the facsimile reproduction by anyone of the patent document or the patent disclosure, as it appears in the Patent and Trademark Office patent file or records, but otherwise reserves all copyright rights whatsoever.

FIELD

This disclosure relates to the field of firearms. More particularly, this disclosure relates to modifications for firearms and methods therefor.

BACKGROUND

Firearm technology is constantly evolving to provide safer, more efficient, and/or more reliable firearms. The Sa vzor 58 rifle was developed in Czechoslovakia between 1956 and 1958 and soon became the standard firearm in that country during its years as a Soviet controlled country. Various versions of the Sa vzor 58 have become very popular with gun collectors, sportsmen, and the like, and a demand has developed for these rifles. However, certain laws (federal and state) prohibit the importation, sell, and/or use of such weapons in the United States unless certain modifications are made to the weapons.

California is particularly well-known for its strict gun laws including, for example, California Penal Code section 12276.1(a)(1) regarding detachable magazines and the requirement that certain weapons not be equipped with detachable magazines. One way to comply with this legal provision is by the use of a "bullet button" which requires an external object (e.g., a bullet or tool) to depress a button so that a magazine can be released from a magazine well on a weapon. However, laws are subject to change, and there has been a growing trend to further limit the dissemination of firearms. Thus, in the years to come, a "bullet button" device may not be enough for law abiding weapons enthusiasts to import, own, or otherwise use a rifle such as a modified Sa vzor 58.

What is needed, therefore, is an even more restrictive means to prevent a magazine from being released from a weapon quickly.

SUMMARY

The above and other needs are met by a first embodiment of the disclosure including a modifying apparatus used for modifying an Sa vzor 58 rifle by placing the apparatus at least partially within the magazine well of the rifle so that a magazine placed in a clipped position relative to the rifle cannot be detached from the rifle unless the rifle is substantially disassembled. The apparatus includes multifaceted rigid object having a proximal end and a distal end oriented along a first axis and an engagement end and a back end oriented along a second axis, wherein the first axis is substantially orthogonal to the second axis, the object including a maximum length ranging from about 11.5 millimeters (mm) to about 12 mm, a maximum width ranging from about 10.5 mm to about 11 mm, and a height defined by the distance from the proximal end of the object to the distal end of the object.

In a second embodiment, the modifying apparatus further includes a passage located substantially widthwise through the object, the passage defining a first aperture along a first face of the object and a second aperture along a second face of the object, wherein the passage defines an imaginary central axis which intercepts a first imaginary point at the center of the first aperture and a second imaginary point at the center of the second aperture, wherein the central axis is located a shortest distance ranging from about 9.7 mm to about 10.1 mm from the distal end of the object, a shortest distance ranging from about 8.5 mm to about 8.9 mm from the back end of the object, a longest distance ranging from about 13.0 mm to about 13.4 mm from the distal end of the object, and a longest distance ranging from about 13.0 mm to about 13.4 mm from the back end of the object, the passage configured for receiving at least a portion of a magazine catch pin.

In a second version of the first embodiment, an Sa vzor 58 rifle is disclosed, the rifle including a magazine well including a groove where a quick-release magazine release lever can be located, a magazine oriented in a clipped position within the magazine well, and the modifying apparatus of the first embodiment wherein the object is located in the groove such that the distal end of the object is oriented toward the rifle chamber of the rifle, the proximal end of the object is oriented away from the rifle chamber, the engagement end of the object is oriented toward the magazine, and the back end of the object is oriented toward a triggering mechanism, wherein the magazine is substantially permanently attached to the groove. Preferably, the magazine is substantially permanently attached to the groove by welding a portion of the object to a surface defining a portion of the groove.

In a second version of the second embodiment, an Sa vzor 58 rifle is disclosed, the rifle including a magazine well including a groove where a quick-release magazine release lever can be located, a magazine oriented in a clipped position within the magazine well, a magazine catch pin, and the modifying apparatus of the second embodiment wherein the object is located in the groove such that the distal end of the object is oriented toward the rifle chamber of the rifle, the proximal end of the object is oriented away from the rifle chamber, the engagement end is oriented toward the magazine, and the back end is oriented toward a triggering mechanism, wherein the magazine catch pin is located through a first rifle catch pin aperture, into the passage of the object, and over to a second rifle catch pin aperture. The rifle may further include a magazine safety pin wherein the safety pin is located at least partially in a magazine safety pin channel for holding the magazine catch pin in a substantially stationary position relative to the rifle. Additionally or alternatively, the magazine is substantially permanently attached to the groove, preferably by welding a portion of the object and/or the magazine to a surface defining a portion of the groove.

A third embodiment of the disclosure includes a magazine configured for being oriented in a clipped position within the magazine well of an Sa vzor 58 rifle, the magazine including an appendage attached adjacent the open end of the magazine, wherein the appendage is configured to fit within a groove of a magazine well where a quick-release magazine release lever can be located.

In a first version of the third embodiment, the appendage includes a multifaceted rigid object having a proximal end and a distal end oriented along a first axis and an engagement end and a back end oriented along a second axis, wherein the first axis is substantially orthogonal to the second axis, the object including a maximum length ranging from about 11.5 millimeters (mm) to about 12 mm, a maximum width ranging from about 10.5 mm to about 11 mm, and a height defined by the distance from the proximal end of the object to the distal end of the object.

In a second version of the third embodiment, the appendage includes a multifaceted rigid object having a proximal end and a distal end oriented along a first axis and an engagement end and a back end oriented along a second axis, wherein the first axis is substantially orthogonal to the second axis, the object including a maximum length ranging from about 11.5 millimeters (mm) to about 12 mm, a maximum width ranging from about 10.5 mm to about 11 mm, a height defined by the distance from the proximal end of the object to the distal end of the object, and a passage located substantially widthwise through the object, the passage defining a first aperture along a first face of the object and a second aperture along a second face of the object, wherein the passage defines an imaginary central axis which intercepts a first imaginary point at the center of the first aperture and a second imaginary point at the center of the second aperture, wherein the central axis is located a shortest distance ranging from about 9.7 mm to about 10.1 mm from the distal end of the object, a shortest distance ranging from about 8.5 mm to about 8.9 mm from the back end of the object, a longest distance ranging from about 13.0 mm to about 13.4 mm from the distal end of the object, and a longest distance ranging from about 13.0 mm to about 13.4 mm from the back end of the object, the passage configured for receiving at least a portion of a magazine catch pin.

A first version of a fourth embodiment of the disclosure includes a Sa vzor 58 rifle including the magazine of the first version of the third embodiment, wherein the magazine is oriented in a clipped position relative to the rifle; the object is located in the groove such that the distal end of the object is oriented toward the rifle chamber of the rifle, the proximal end of the object is oriented away from the rifle chamber, the engagement end is oriented toward the magazine, and the back end is oriented toward a triggering mechanism; and the magazine is substantially permanently attached to the rifle.

A second version of the fourth embodiment of the disclosure includes a Sa vzor 58 rifle including the magazine of the second version of the third embodiment, wherein the magazine is oriented in a clipped position relative to the rifle; the object is located in the groove such that the distal end of the object is oriented toward the rifle chamber of the rifle, the proximal end of the object is oriented away from the rifle chamber, the engagement end is oriented toward the magazine, and the back end is oriented toward a triggering mechanism; and wherein the magazine catch pin is located through a first rifle catch pin aperture, into the passage of the object, and over to a second rifle catch pin aperture. The rifle may further include a magazine safety pin wherein the safety pin is located at least partially in a magazine safety pin channel for holding the magazine catch pin in a substantially stationary position relative to the rifle. Optionally, the magazine may be substantially permanently attached to a magazine well of the rifle, preferably by welding a portion of the magazine to a surface defining a portion of the magazine well.

In addition to various embodiments with various versions of apparatuses as discussed herein, other embodiments of the disclosure include a method of modifying a Sa vzor 58 rifle so that a magazine placed in a clipped position relative to the rifle cannot be detached from the rifle unless the rifle is substantially disassembled. The method includes the steps of (A) providing a Sa vzor 58 rifle including a magazine well having a groove where a quick-release magazine release lever is typically located; (B) putting a magazine in a clipped position within the magazine well of an Sa vzor 58 rifle; (C) placing a modifying apparatus at least partially within the groove of the magazine well in a first position, wherein the object, when substantially in the first position, prevents the magazine from moving out of a clipped position; and (D) attaching the magazine to a surface defining a portion of the magazine well.

In a first version, step D further includes welding a portion of the magazine to a surface defining a portion of the magazine well.

In a second version, the modifying apparatus of step C further includes a multifaceted rigid object having a proximal end and a distal end oriented along a first axis and an engagement end and a back end oriented along a second axis, wherein the first axis is substantially orthogonal to the second axis, the object including a maximum length ranging from about 11.5 millimeters (mm) to about 12 mm, a maximum width ranging from about 10.5 mm to about 11 mm, and a height defined by the distance from the proximal end of the object to the distal end of the object. In a related version, the modifying apparatus of step C further includes a passage located substantially widthwise through the object, the passage defining a first aperture along a first face of the object and a second aperture along a second face of the object, wherein the passage defines an imaginary central axis which intercepts a first imaginary point at the center of the first aperture and a second imaginary point at the center of the second aperture, wherein the central axis is located a shortest distance ranging from about 9.7 mm to about 10.1 mm from the distal end of the object, a shortest distance ranging from about 8.5 mm to about 8.9 mm from the back end of the object, a longest distance ranging from about 13.0 mm to about 13.4 mm from the distal end of the object, and a longest distance ranging from about 13.0 mm to about 13.4 mm from the back end of the object, the passage configured for receiving at least a portion of a magazine catch pin; and wherein step D further includes inserting a magazine catch pin through a first rifle catch pin aperture, into the passage of the object, and over to a second rifle catch pin aperture. In yet another related version, step D further includes driving a magazine safety pin into a magazine safety pin channel for holding the magazine catch pin in a substantially stationary position relative to the rifle.

The previously summarized embodiments of the disclosure have been listed as examples only and are not meant to be limiting. These and other embodiments have many advantages, including providing a relatively inexpensive kit and/or apparatus and relatively simple methods to modify Sa vzor rifles to bring such rifles well within the limits of local, state, and/or federal laws.

With regards to certain embodiments described above, in order for a magazine safety pin to be removed, it is necessary for the receiver cover to be removed so that a distal end of the magazine safety pin may be hammered or otherwise manipulated so as to force the magazine safety pin out of the magazine safety pin channel. Thus, the magazine, when oriented in a clipped position, cannot be removed unless the rifle is substantially disassembled. With regards to the embodiments disclosed wherein the object (or variation thereof) is permanently attached (e.g., welded) to one or more of the magazine well surfaces surface(s), the magazine cannot be removed at all without causing undesirable damage to the rifle.

Many current technologies allow a user to use a hand tool to disengage a magazine from a rifle, but these technologies are at the very edge of the law in some jurisdictions and may be nonviable as gun laws fluctuate throughout the United States. Thus, the apparatuses, kits, and methods described herein provide a conservative and viable option to modify Sa vzor 58 rifles or otherwise use a modified Sa vzor 58 rifle with confidence that such use is within the limits of most if not all applicable gun laws in the United States related to firearms.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). To the extent that any term below diverges from the commonly understood and/or dictionary definition of such term, the definitions below control.

Clipped Position: the position of a magazine relative to a rifle such that the magazine is secured to the rifle in a manner in which a round can be fired from the magazine (if at least one round is present in the magazine).

Magazine: a device for holding one or more rounds of ammunition and, in some cases, urging one or more rounds to a firing chamber of a rifle to which the magazine is attached in a clipped position.

Magazine Catch Pin: an elongated, preferably cylindrical, pin configured for extending through the width of a rifle along a passage to hold two or more objects together, preferably having a diameter or average cross-sectional distance ranging from about 3.8 mm to about 4.2 mm, and a length ranging from about 27 mm to about 31 mm.

Magazine Safety Pin: an elongated nail-like device preferably including a nail-like head and a bifurcated distal end defining a first leg and a second leg, wherein the second leg is preferably longer than the first leg and wherein the second leg preferably includes a ridge for holding the magazine safety pin in place after the magazine safety pin has been inserted into a magazine safety pin channel. The first leg preferably has a length ranging from about 24 mm to about 28 mm, and the second leg (including the ridge) preferably has a length ranging from about 26 mm to about 30 mm. The head preferably has a thickness of about 1 mm and a diameter or average cross-sectional length ranging from about 4 mm to about 6 mm.

Magazine Safety Pin Channel: An aperture along a ventral surface of a rifle where a magazine safety pin may be inserted so as to come into frictional contact with a magazine catch pin (if a magazine catch pin is present) whereby the magazine catch pin is substantially held in place by the magazine safety pin.

Magazine Well: a three-dimensional space defined at least in part by the contour of a receiver and including, for example, the space where a quick release mechanism is typically located.

Passage: a substantially linear channel, preferably cylindrical in shape, extending from an aperture located along a first side of an object to an aperture located along a second side of an object.

Figure 18:
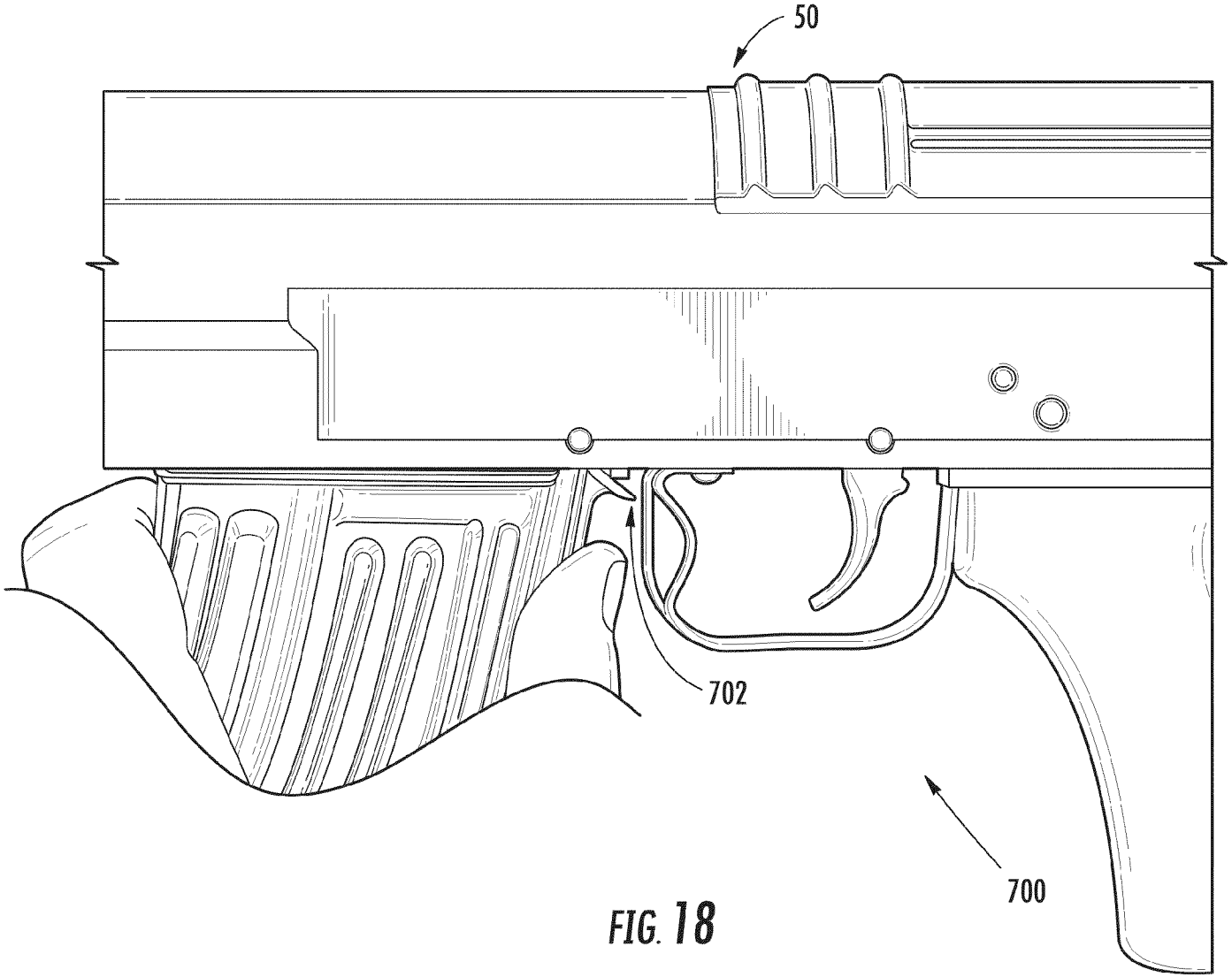
FIG. 18 shows a first step in the removal of a magazine from the magazine well of an Sa vzor 58 rifle by depressing a lever of a common magazine quick release mechanism.

Receiver Cover: particularly with respect to a Sa vzor 58, a "receiver cover" 50 is that portion or portions of a rifle that cover the receiver as shown, for example, in FIG. 18.

Substantially Disassembled: the state of a rifle—particularly a Sa vzor 58 rifle—in which the receiver cover has been removed. This is typically a necessary step in order to remove a magazine safety pin from a Sa vzor 58 rifle.

FIGS. 1A-1G show various views of an embodiment of the invention including a multifaceted rigid object 100. The object 100 or other embodiments thereof can be described by defining a distal end 102 and a proximal end 104 as well as an engagement end 106 and a back end 108. The distal end 102 end and the proximal end 104 together define a first axis 110 which is generally oriented in the dimension hereinafter referred to as "height" or the "height dimension." The engagement end 106 and the back end 108 together define a second axis 112 which is generally oriented in the dimension hereinafter referred to as "length" or the "length dimension." The first axis 110 is preferably substantially orthogonal to the second axis 112.

The object 100 further includes a passage 114 that extends through the dimension hereinafter referred to as "width" or the "width dimension" along a third axis 116. The passage 114 defines a first aperture 118 along a first side face 120 of the object 100 and a second aperture 122 along a second side face 124 of the object 100. The third axis 116 extends along an imaginary line passing through a first central point 126 of the first aperture 118 and a second central point 128 of the second aperture 122. Thus, in certain embodiments, the third axis could be referred to as a "central" axis because it runs in linear fashion between the first central point 126 and the second central point 128. In the embodiment shown in FIGS. 1A-1G, the first central point 126 and the second central point 128 are easily determined because the first aperture 118 and the second aperture 122 are each in the form of an orifice having a circular shape. The length of the diameters defining the first aperture 118 and the second aperture range from about 1.7 mm to about 2.4 mm, and most preferably about 2.1 mm. Although a circular shaped cross section through the passage 114 is preferred, other embodiments may include, for example, a passage including an irregular shaped cross section, a dynamically shaped cross section that differs along the third axis, or a regular shaped cross section in the shape of a polygon or non-circular curved shape.

Figure 1A:
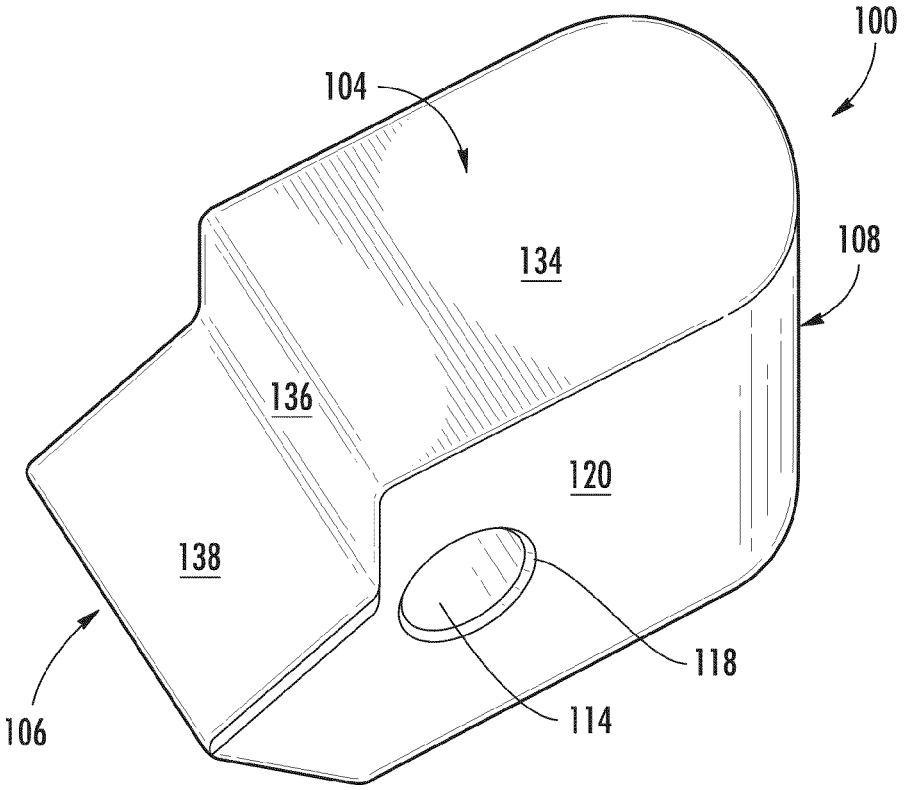
FIG. 1A shows a perspective illustrative view of an apparatus for blocking a magazine from being disengaged from an Sa vzor 58 rifle.
Figure 1B:
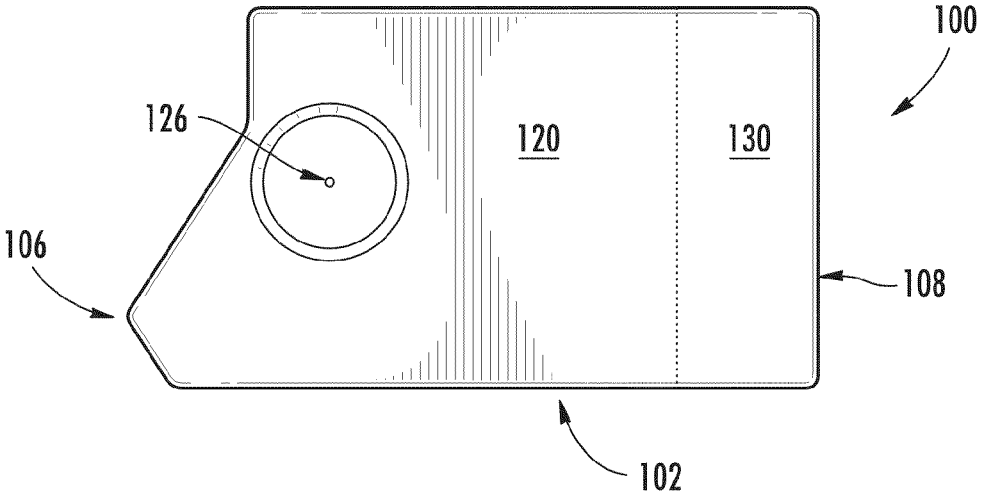
FIG. 1B shows a side illustrative view of an apparatus for blocking a magazine from being disengaged from an Sa vzor 58 rifle.
Figure 1C:
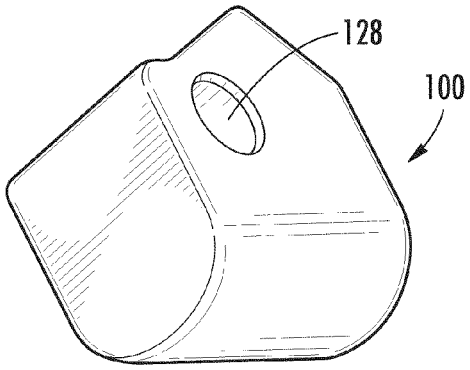
FIG. 1C shows another perspective view of an apparatus for blocking a magazine from being disengaged from an Sa vzor 58 rifle.
Figure 1D:
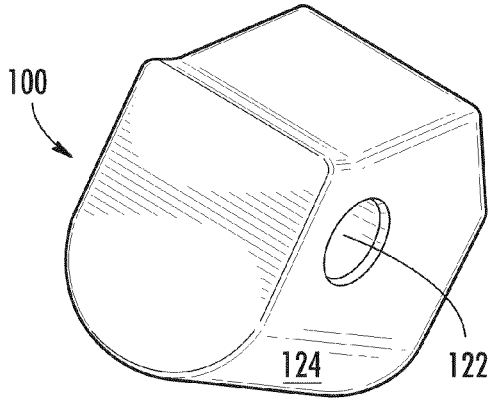
FIG. 1D shows another perspective view of an apparatus for blocking a magazine from being disengaged from an Sa vzor 58 rifle.
Figure 1E:
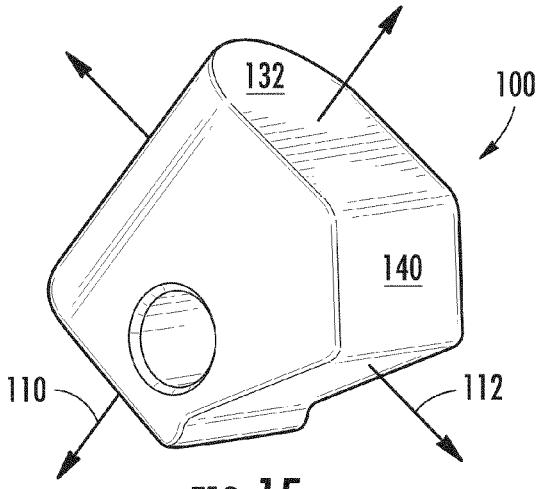
FIG. 1E shows another perspective view of an apparatus for blocking a magazine from being disengaged from an Sa vzor 58 rifle.
Figure 1F:
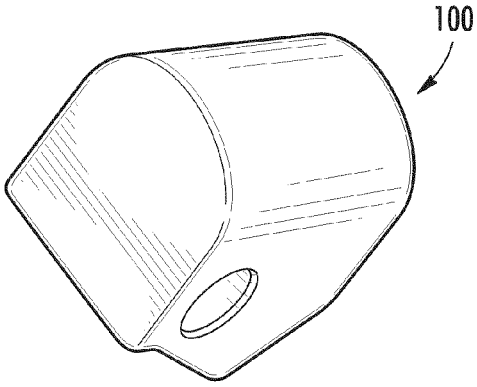
FIG. 1F shows another perspective view of an apparatus for blocking a magazine from being disengaged from an Sa vzor 58 rifle.
Figure 1G:
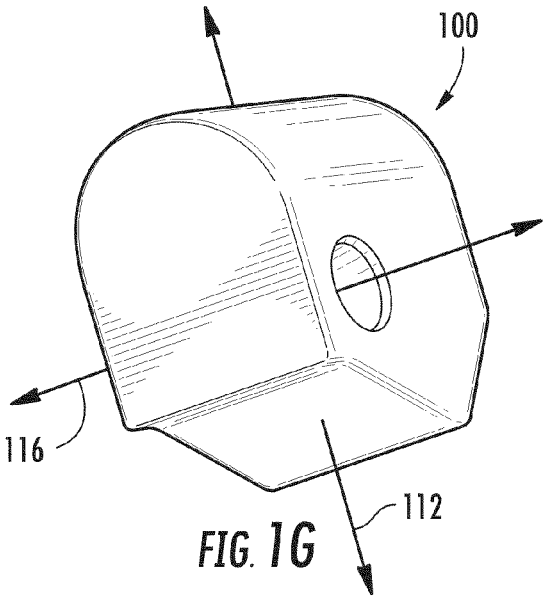
FIG. 1G shows another perspective view of an apparatus for blocking a magazine from being disengaged from an Sa vzor 58 rifle.
Figure 2:
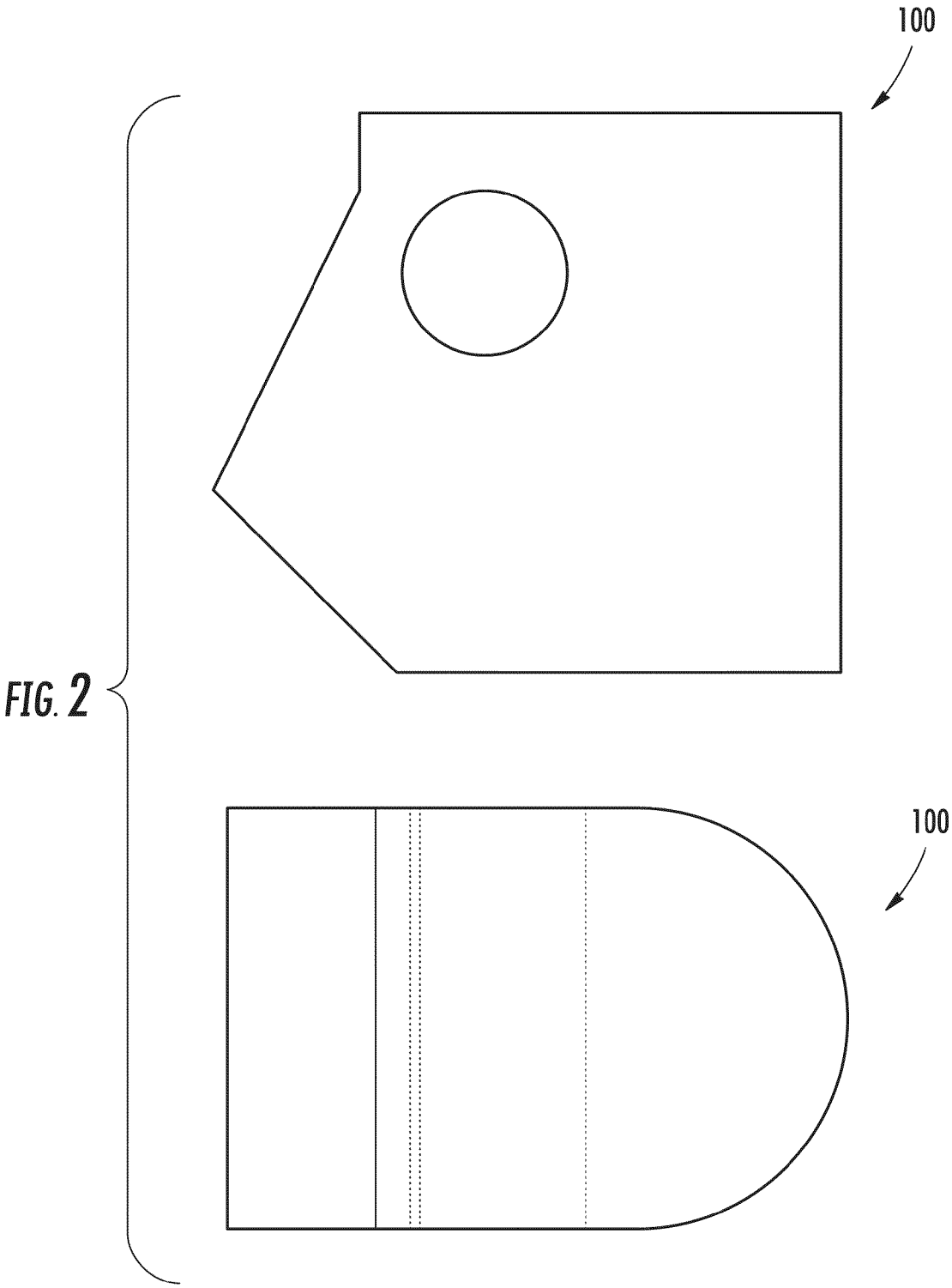
FIG. 2 shows another side view of an apparatus for blocking a magazine from being disengaged from an Sa vzor 58 rifle with preferred dimensions shown.

The embodiment shown in FIGS. 1A-1G includes a specific arrangement of faces including the first side face 120 and the second side face 124 as well as an end face 130, a distal face 132, a proximal face 134, a first engagement face 136, a second engagement face 138, and a third engagement face 140. FIG. 2 shows preferred dimensions for the embodiment shown in FIG. 1 and shows that the end face 130 is preferably a curved surface that extends around at approximately 180 degrees. The dimensions shown in FIG. 2 are given in millimeters (mm) with preferred tolerance ranges of +/−0.1 mm. However, less precise versions of the embodiment shown in FIGS. 1-2 are contemplated viable and useful by Applicant.

Figure 3:
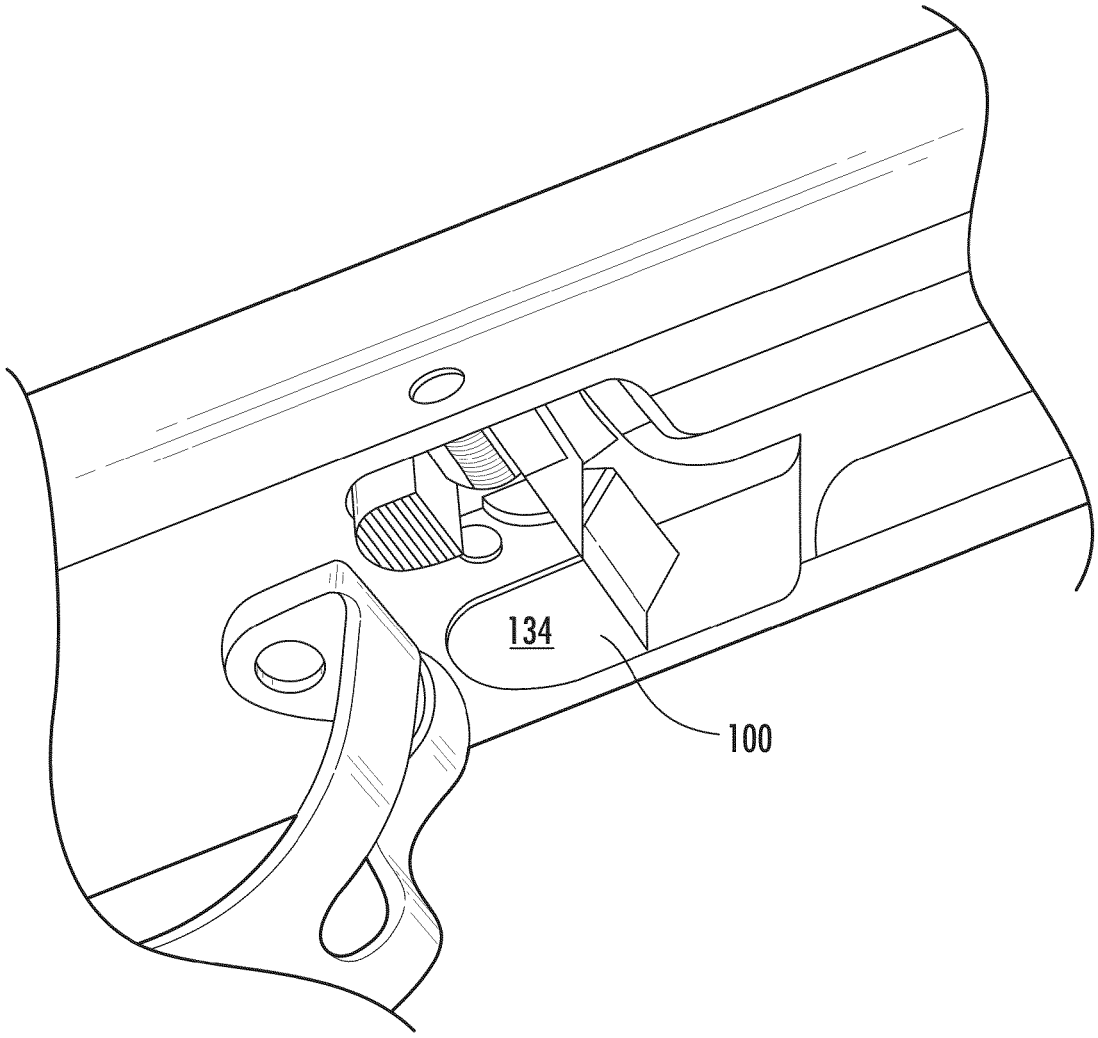
FIG. 3 shows a perspective illustrative view of an Sa vzor 58 rifle wherein the apparatus shown in FIGS. 1A-1G is located in a groove of a magazine well of the rifle.
Figure 4A:
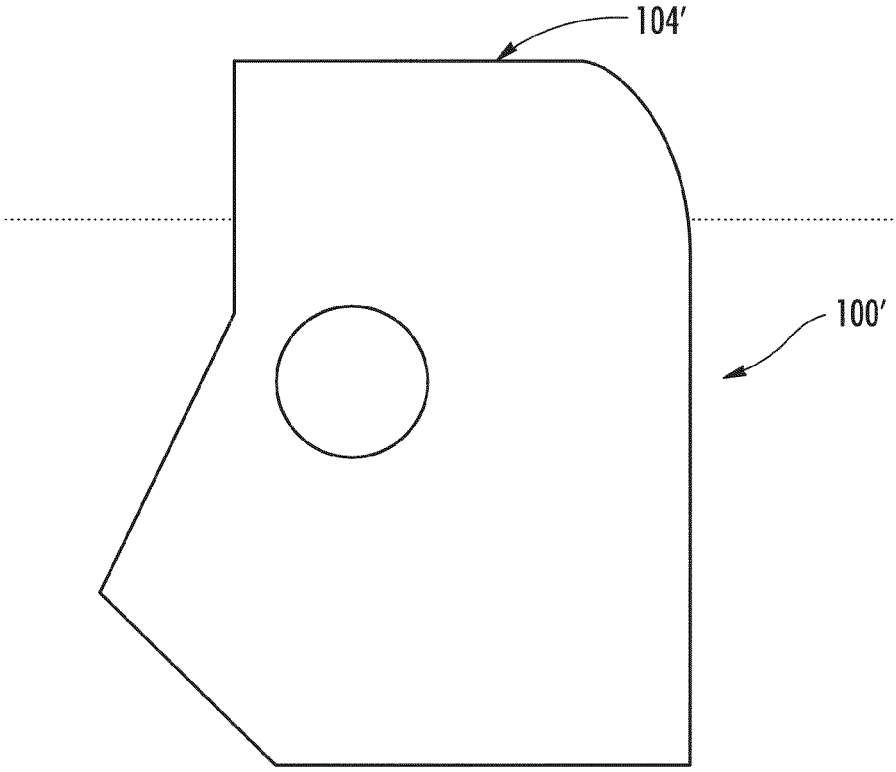
FIG. 4A shows an alternate embodiment of the apparatus shown in FIGS. 1A-1G, but including an extended proximal end of the apparatus.
Figure 4B:
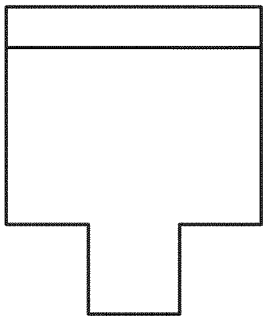
FIG. 4B shows a view looking at the engagement end of an alternate embodiment of the apparatus shown in FIGS. 1A-1G including a narrow distal end.
Figure 4C:
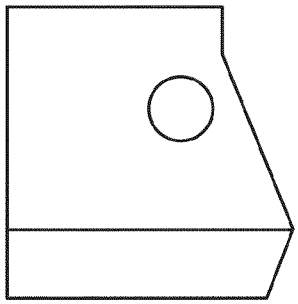
FIG. 4C shows a side view of an alternate embodiment of the apparatus shown in FIGS. 1A-1G including a narrow distal end.
Figure 4D:
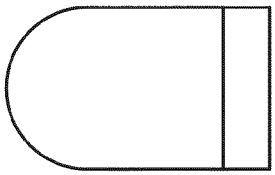
FIG. 4D shows a view looking at the proximal end of an alternate embodiment of the apparatus shown in FIGS. 1A-1G including a narrow distal end.
Figure 4G:
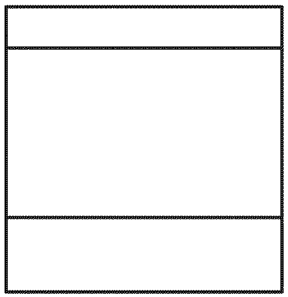
FIG. 4G shows a view looking at the engagement end of an alternate embodiment of the apparatus shown in FIGS. 1A-1G including a narrow back end.
Figure 4J:
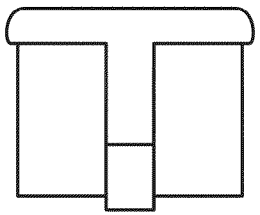
FIG. 4J shows a view looking at an engagement end of an alternate embodiment of the apparatus shown in FIGS. 1A-1G including a narrow body in all three primary axial directions.
Figure 4F:
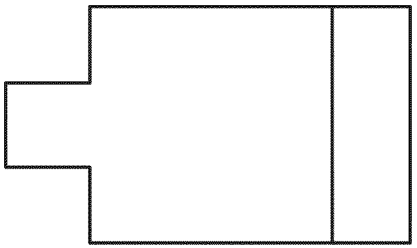
FIG. 4F shows a view looking at the proximal end of an alternate embodiment of the apparatus shown in FIGS. 1A-1G including a narrow back end.
Figure 4I:
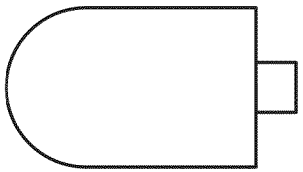
FIG. 4I shows a view looking at the proximal end of an alternate embodiment of the apparatus shown in FIGS. 1A-1G including a narrow body in all three primary axial directions.
Figure 4E:
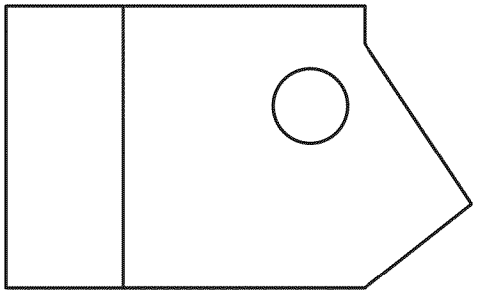
FIG. 4E shows a side view of an alternate embodiment of the apparatus shown in FIGS. 1A-1G including a narrow back end.
Figure 4H:
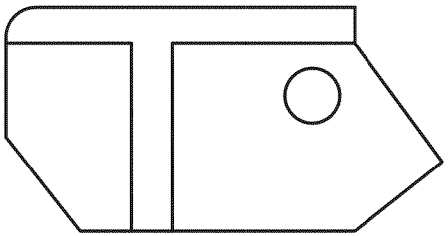
FIG. 4H shows a side view of an alternate embodiment of the apparatus shown in FIGS. 1A-1G including a narrow body in all three primary axial directions.

Generally, the preferred maximum length of the object 100 ranges from about 11.5 mm to about 12.0 mm. The preferred maximum width of the object 100 ranges from about 10.5 mm to about 11.0 mm. The preferred maximum height of the object 100 preferably ranges from about 13.8 mm to about 14.2 mm so that the proximal face 134 is substantially flush with the surrounding surface of a rifle to which the object 100 may be attached as shown, for example, in FIG. 3. However, the distance between the proximal end 104 and the distal end 102 may be greater than 14.2 mm (e.g., ranging from about 14.2 mm to about 25 mm or more) such that the proximal end 104' of a related embodiment object 100' extends beyond the surrounding surface of a rifle to which the object 100' is attached as shown in FIG. 4A. FIGS. 4B-4J show examples of some other potential embodiments with various faces and surface orientations, but having the same structural characteristics as defined above with respect to the first axis 110, the second axis 112, and the third axis 116. FIGS. 4A-4J show a small sampling of the various shapes that are contemplated by this disclosure.

With reference back to the embodiment shown in FIGS. 1A-1G, the third axis 116 is preferably located a shortest distance from the distal end 102 of the object 100 of from about 9.7 mm to about 10.1 mm, and most preferably about 9.9 mm. The third axis 116 is also preferably located a shortest distance from the back end 108 of the object 100 of from about 8.5 mm to about 8.9 mm, and most preferably about 8.7 mm.

Figure 5:
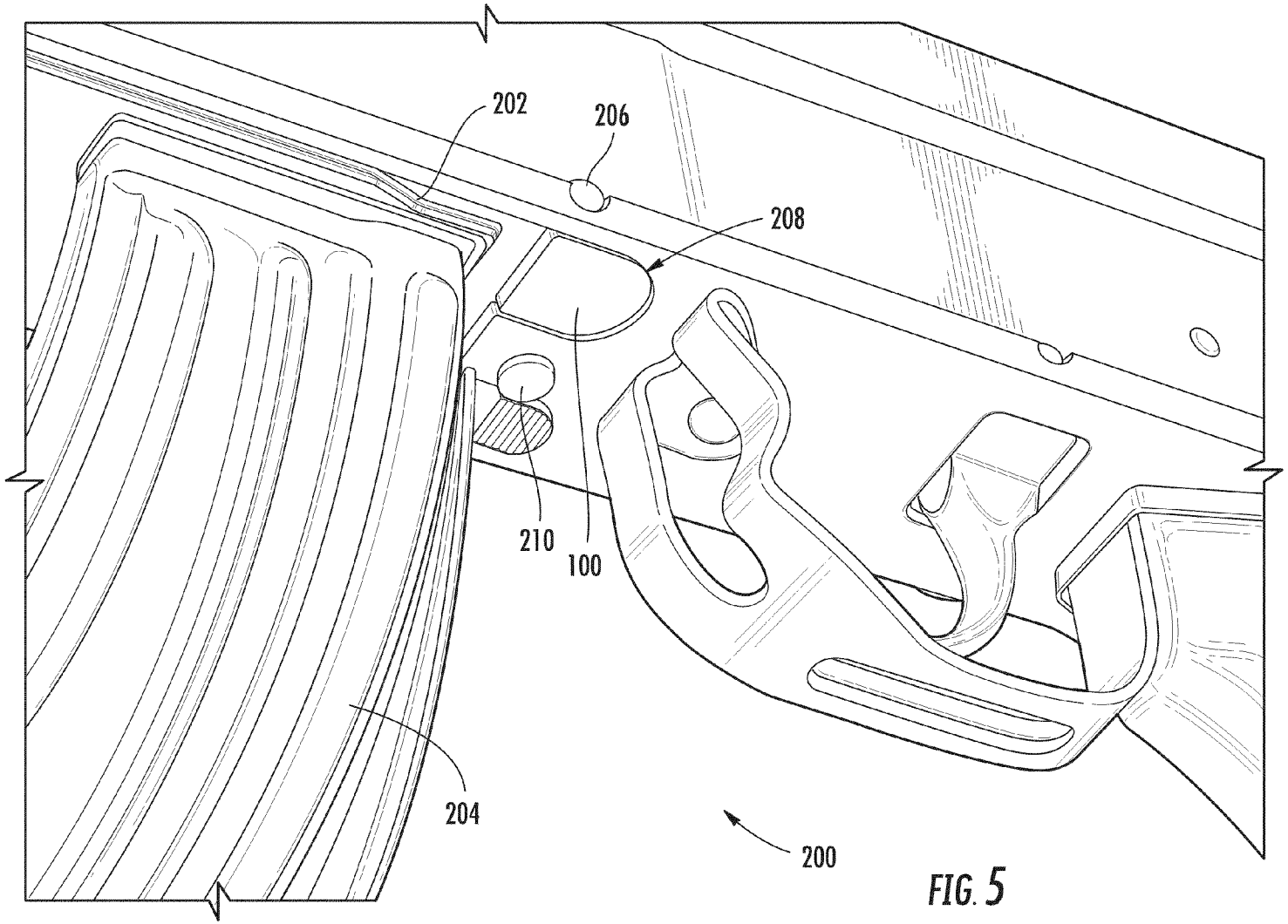
FIG. 5 shows a perspective view of an Sa vzor 58 rifle wherein the apparatus shown in FIGS. 1A-1G is located in a groove of a magazine well of the rifle along with a magazine.
Figure 6:
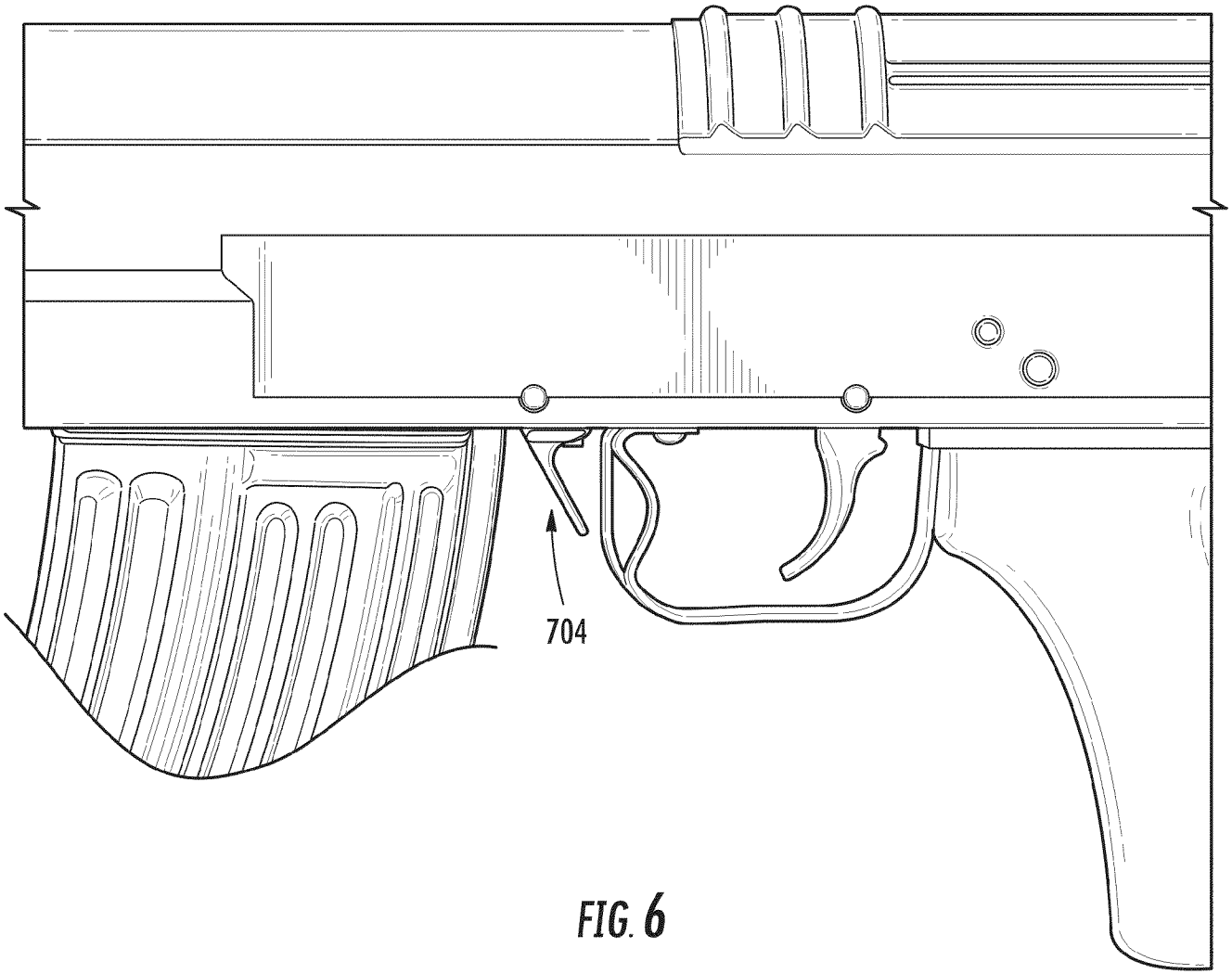
FIG. 6 shows a side view of an Sa vzor 58 rifle including a standard magazine quick release mechanism.

Another embodiment of the invention is shown in FIG. 5 including a first version of a Sa vzor 58 rifle 200 including the object 100 (or variation thereof) described above. The rifle 200 also includes a magazine well 202, a magazine 204 oriented in a clipped position with the magazine well 202, and a magazine catch pin 206. The magazine well 202 further includes a groove 208 where a spring-loaded magazine quick release lever (shown in FIG. 6) is typically located, but where the object 100 is located to prevent quick release of the magazine 204 without substantial disassembly of the rifle 200. The object 100 is located in the groove 208 such that the distal end 102 of the object 100 is oriented toward (i.e., "substantially facing") the rifling chamber of the rifle, the proximal end 104 of the object 100 is oriented away from the rifling chamber, the engagement end 106 of the object 100 is oriented toward the magazine 204, and the back end 108 of the object 100 is oriented toward a triggering mechanism.

The rifle 200 also preferably includes a magazine safety pin 210 which, in typical Sa vzor 58 rifles, functions (at least in part) to maintain the magazine catch pin 206 in place so that, among other things, the magazine 204 does not detach during firing of the rifle 200. The object 100, the magazine catch pin 206, and the magazine safety pin 210 are shown in disassembled form in FIGS. 7A-7C. When the rifle 200 is substantially fully assembled, the magazine catch pin 206 is located through a first catch pin aperture 216, into the passage 114 of the object 100, and over to a second catch pin aperture 218 such that the passage 114 is substantially aligned with the first rifle catch pin aperture 216 and the second catch pin aperture 218. FIG. 8 shows the magazine catch pin 206 being inserted through the first rifle catch pin aperture 216 and into the passage 114.

Figure 9:
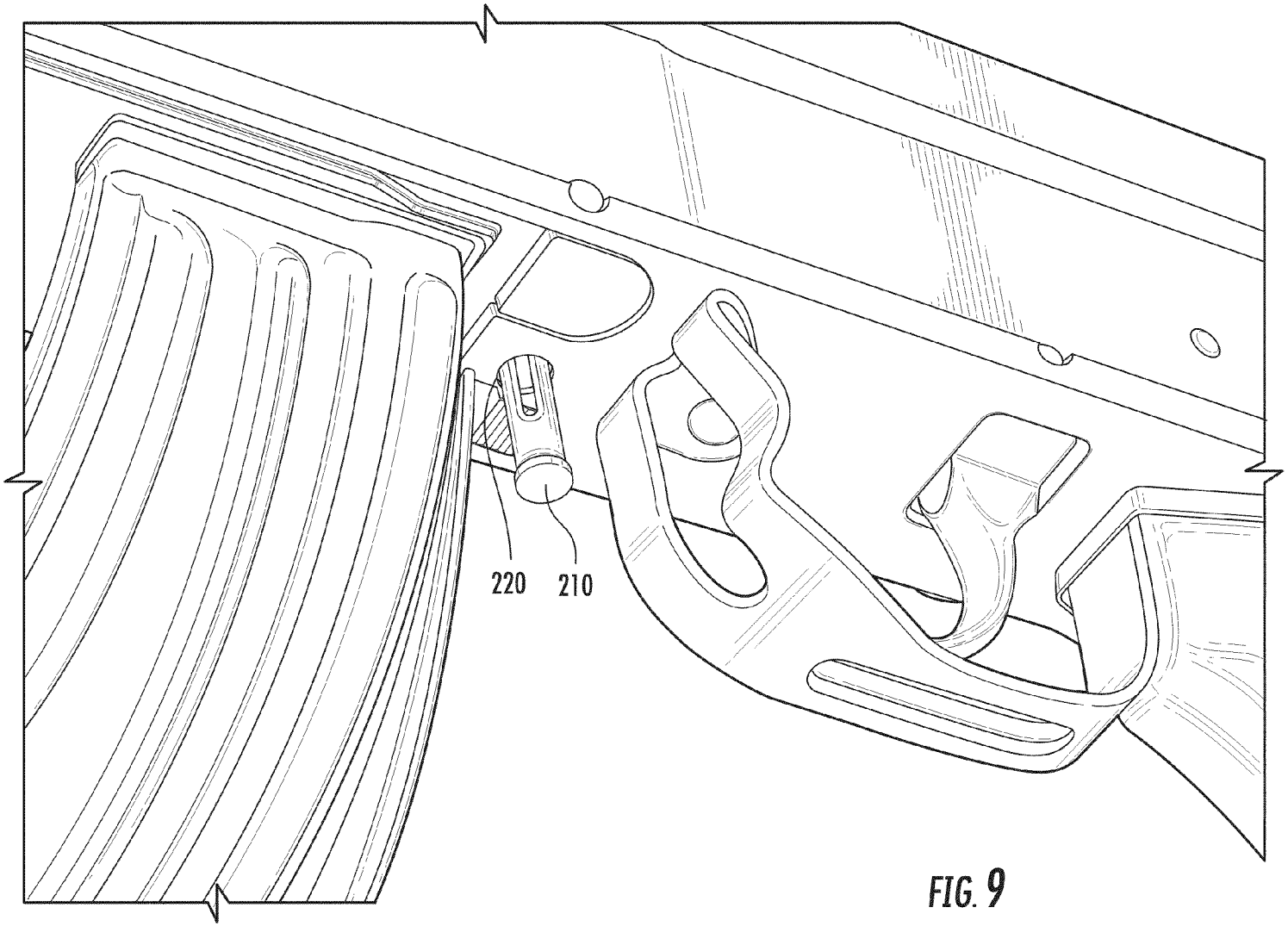
FIG. 9 shows a perspective view of an Sa vzor 58 rifle wherein the magazine safety pin of FIG. 7C is being inserted into a magazine safety pin channel of the rifle.

In similar fashion (but in a different spatial orientation), the magazine safety pin 210 is located at least partially in a magazine safety pin channel 220 oriented substantially orthogonal to the catch pin 206 helping to hold the catch pin 206 in a relatively stationary position, thereby ensuring that the object 100 remains in place which further guarantees that the magazine 204 remains in a clipped position. FIG. 9 shows the magazine safety pin 210 being inserted into the magazine safety pin channel 220.

In the embodiment shown in FIG. 5, the magazine 204 is configured for holding no more than ten rounds of ammunition. In another embodiment, for example, a magazine may be used that is configured for holding about thirty rounds of ammunition. The capacity of the magazine used is not necessarily relevant so long as such magazine is configured to be in a clipped position with the rifle 200.

Figure 10:
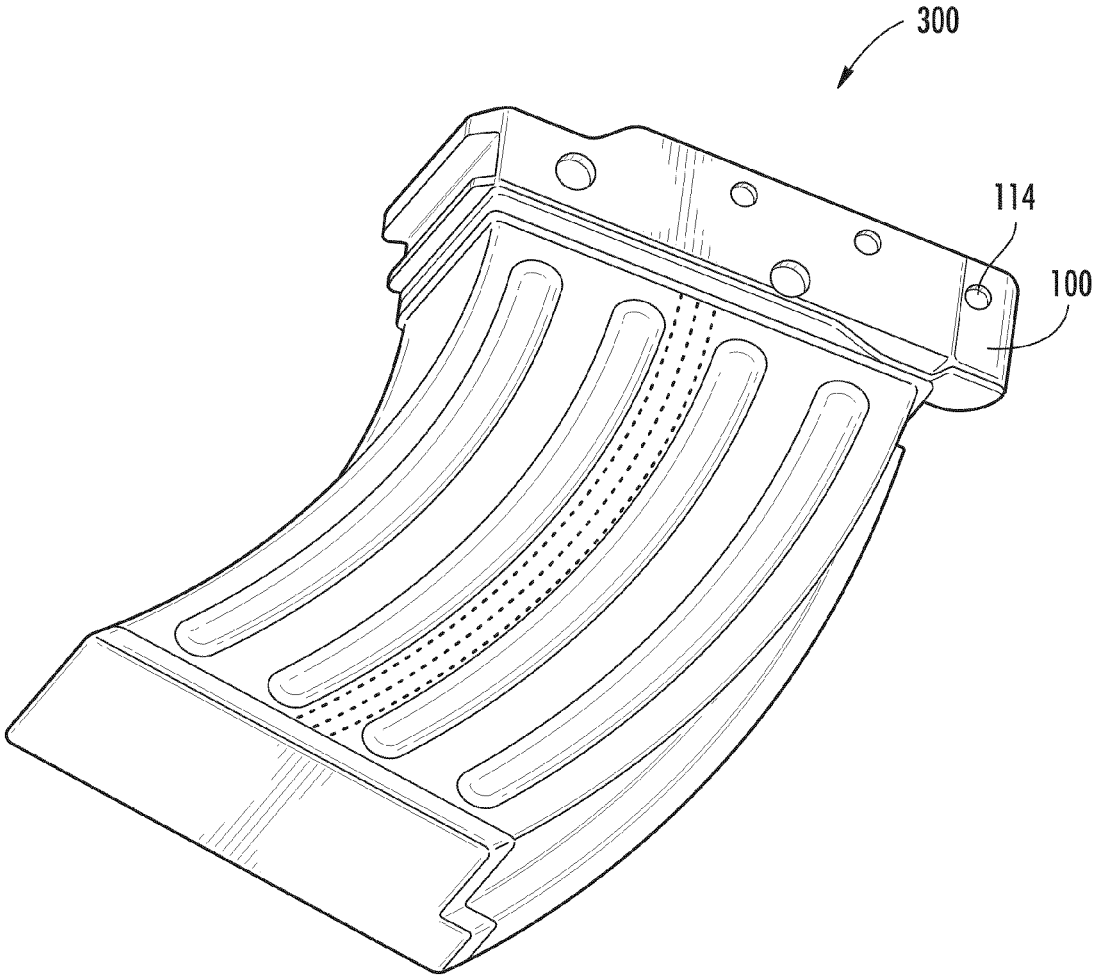
FIG. 10 shows an embodiment of a modified magazine including the apparatus shown in FIGS. 1A-1G permanently attached thereto.

In a related embodiment shown in FIG. 10, a magazine 300 is contemplated wherein the magazine 300 further includes the object 100 (or variation thereof) permanently attached as a part of the magazine 300 by, for example, welding. The magazine 300 is configured to be in a clipped position with a Sa vzor 58 rifle including the groove 208 described above. The magazine 300 is preferably further configured such that the first aperture 118 and the second aperture 122 of the object 100 substantially align with first magazine catch pin aperture 216 and the second magazine catch pin aperture 218, respectively, of an Sa vzor 58 rifle so that the magazine 300 may be held in place with no quick release capability by the magazine catch pin 206 and the magazine safety pin 210.

Figure 11:
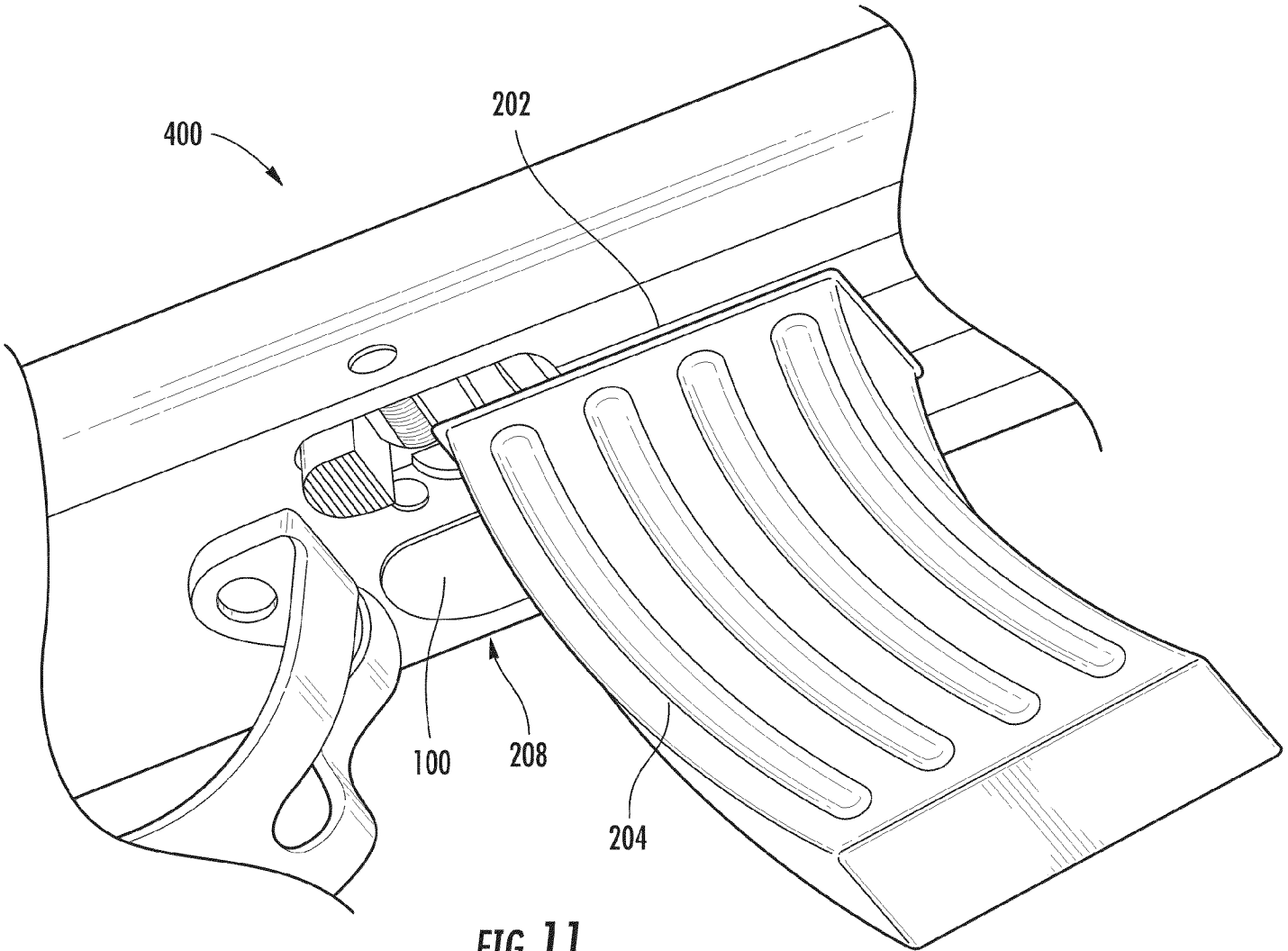
FIG. 11 shows an embodiment of an Sa vzor 58 wherein the apparatus shown in FIGS. 1A-1G is permanently attached to a groove in the magazine well after a magazine has been oriented in a clipped position.

In yet another embodiment shown in FIG. 11, a second version of a Sa vzor rifle 400 includes the object 100 (or variation thereof) described above. The rifle 400 also includes the magazine well 202 and the magazine 204 oriented in a clipped position with the magazine well 202. The magazine well 202 further includes the groove 208 where a spring-loaded magazine quick release lever (shown in FIG. 6) is typically located, but where the object 100 has been attached to prevent release of the magazine 204. In this embodiment, the object 100 is permanently attached to the groove 208 by, for example, welding after the magazine 204 has been oriented in a clipped position. This way, the magazine 204 may not be removed. Therefore, in this particular embodiment, the rifle 400 must be rifle loaded from the top of the rifle 400. In a related embodiment, a modified version of the object 100 is used wherein there is no passage 114. The passage 114 is preferred, however, because the placement of the magazine catch pin 206 through the first rifle catch pin aperture 216, through the passage 114 of the object 100, and through the second catch pin aperture 218 helps to properly position the object 100 prior to welding the object 100 with the surrounding groove 208 surfaces.

Figure 7A:
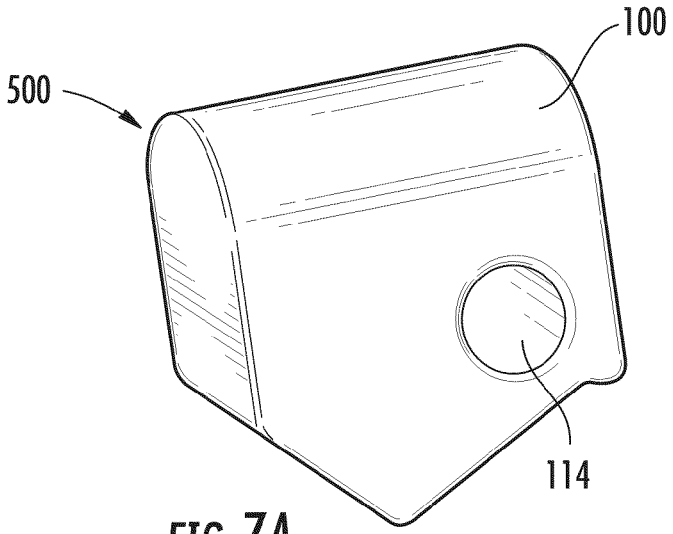
FIG. 7A shows a perspective view of the apparatus shown in FIGS. 1A-1G.
Figure 7B:
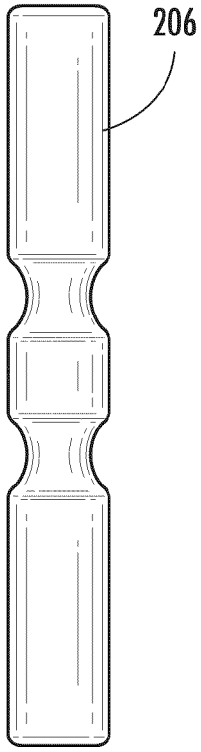
FIG. 7B shows a side view of a magazine catch pin.
Figure 7C:
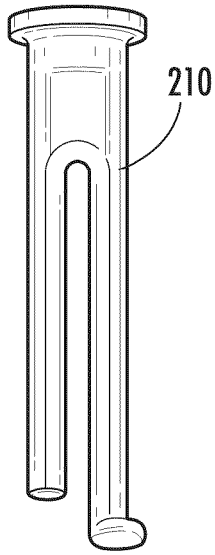
FIG. 7C shows a side view of a magazine safety pin.
Figure 8:
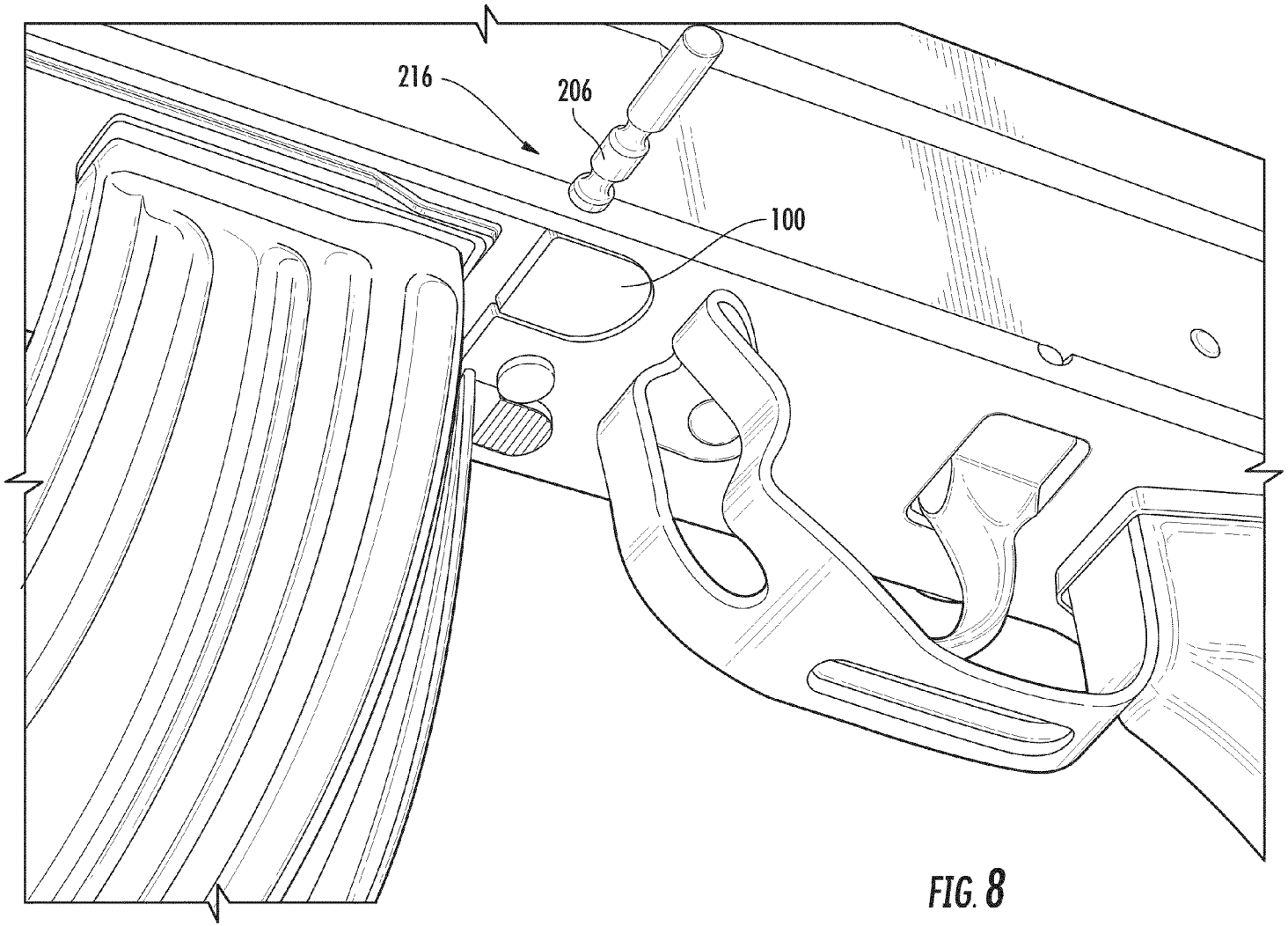
FIG. 8 shows a perspective view of an Sa vzor 58 rifle wherein the magazine catch pin of FIG. 7B is being inserted through portions of the rifle as well as through a passage defined in the apparatus shown in FIGS. 1A-1G.

FIGS. 7A-7C shows embodiments of a kit 500 of parts for use to modify a Sa vzor 58 rifle. The kit 500 includes the object 100 (or variation thereof). In a preferred embodiment, the kit 500 further includes the magazine catch pin 206 and the magazine safety pin 210. Typically, a rifle being modified already has a magazine catch pin and a magazine safety pin. However, such parts may be worn or otherwise damaged, so the preferred embodiment of the kit 500 provides extra parts.

The object 100 is preferably made of metals or metal alloys such as, for example, steel, stainless steel, aluminum, titanium, iron, cobalt, nickel, copper, zinc, and mixed alloys thereof. The magazine catch pin 206 and the magazine safety pin 210 are also preferably made of the same material(s).

Figure 12:
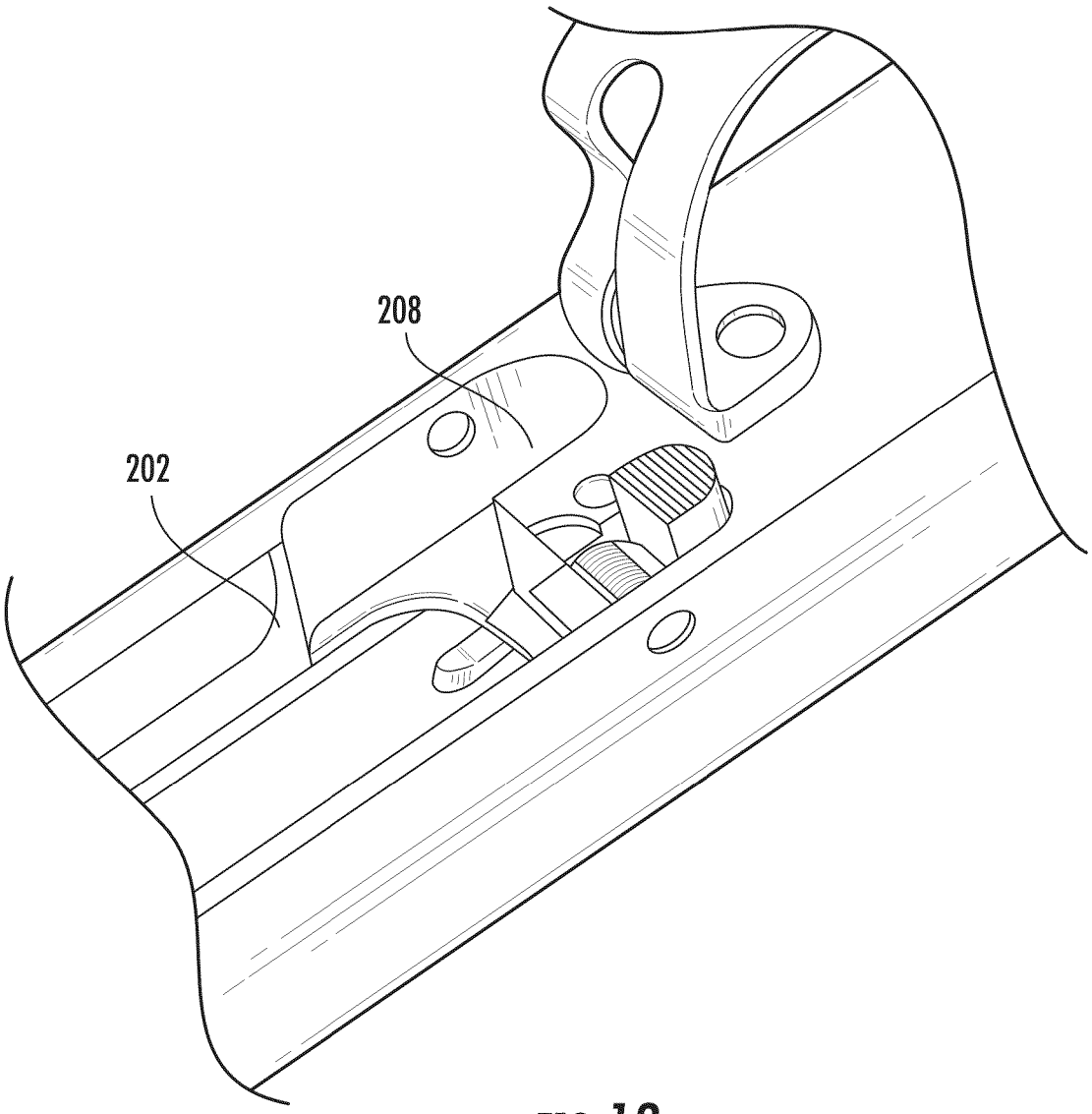
FIG. 12 shows a perspective view of an Sa vzor 58 rifle including a magazine well with no magazine inserted therein.
Figure 13:
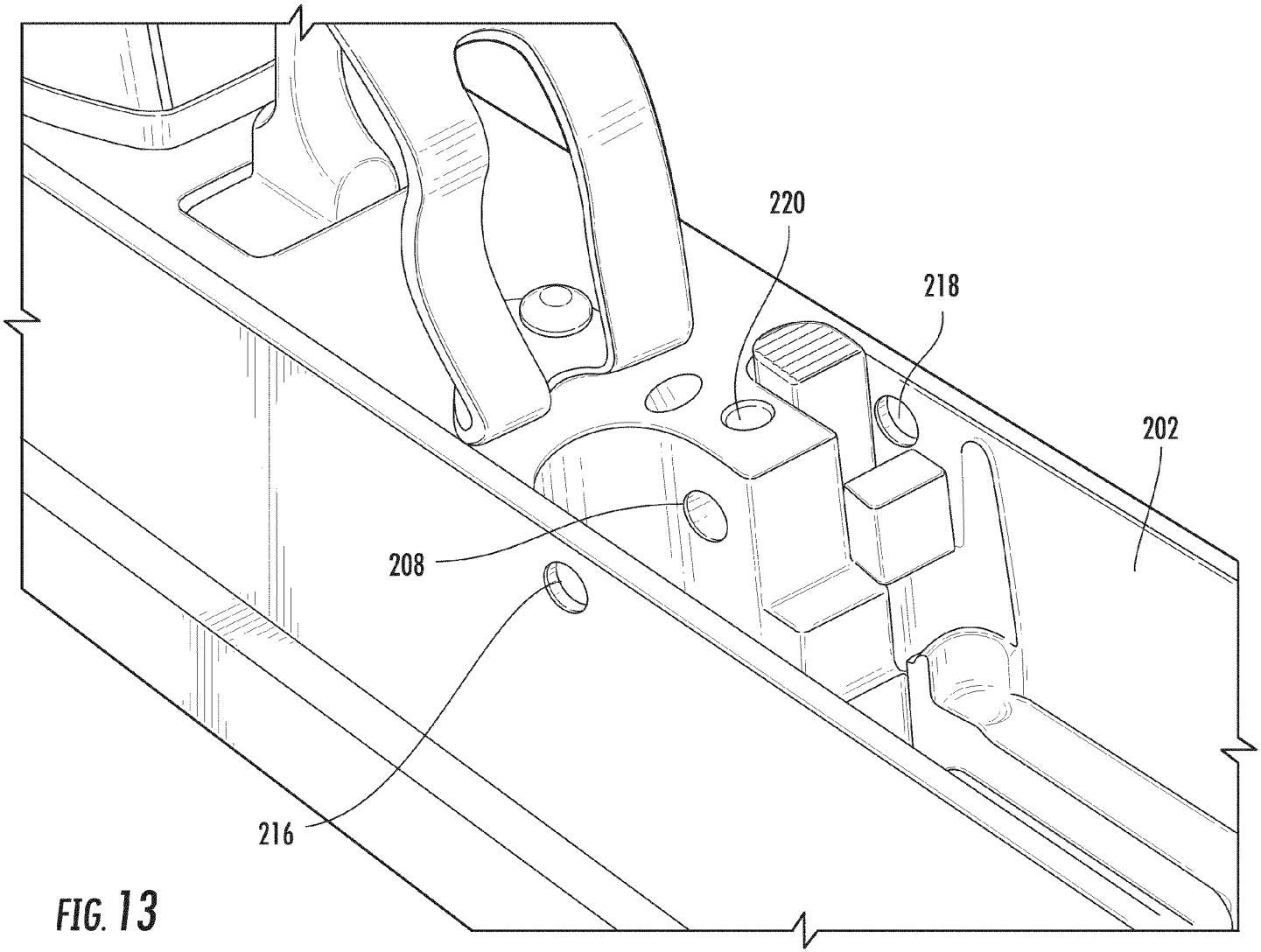
FIG. 13 shows another perspective view of an Sa vzor 58 rifle including a magazine well with no magazine inserted therein.
Figure 14:
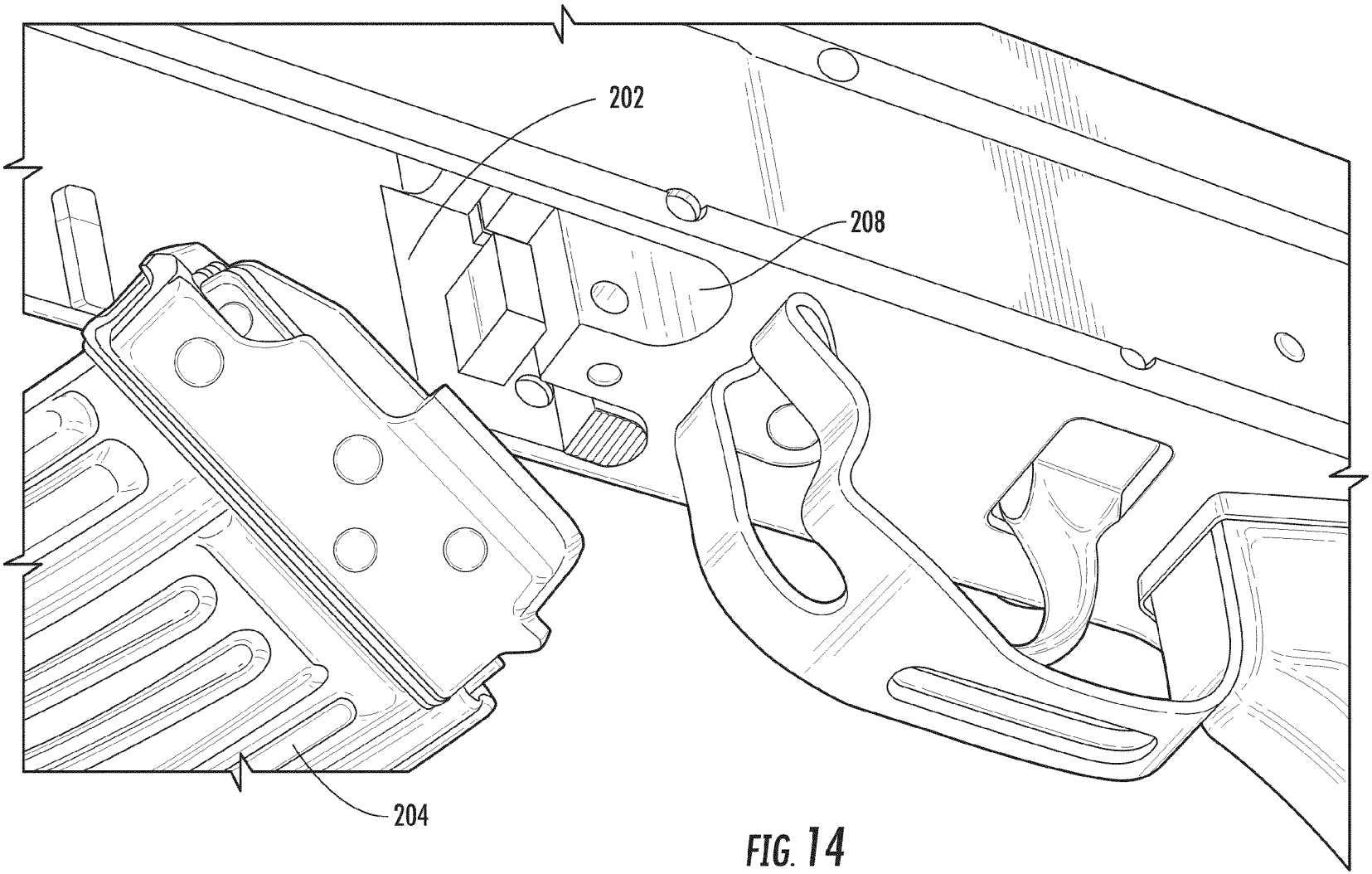
FIG. 14 shows another perspective view of the Sa vzor 58 rifle of FIGS. 12-13 wherein a magazine is being oriented toward the magazine well.
Figure 15:
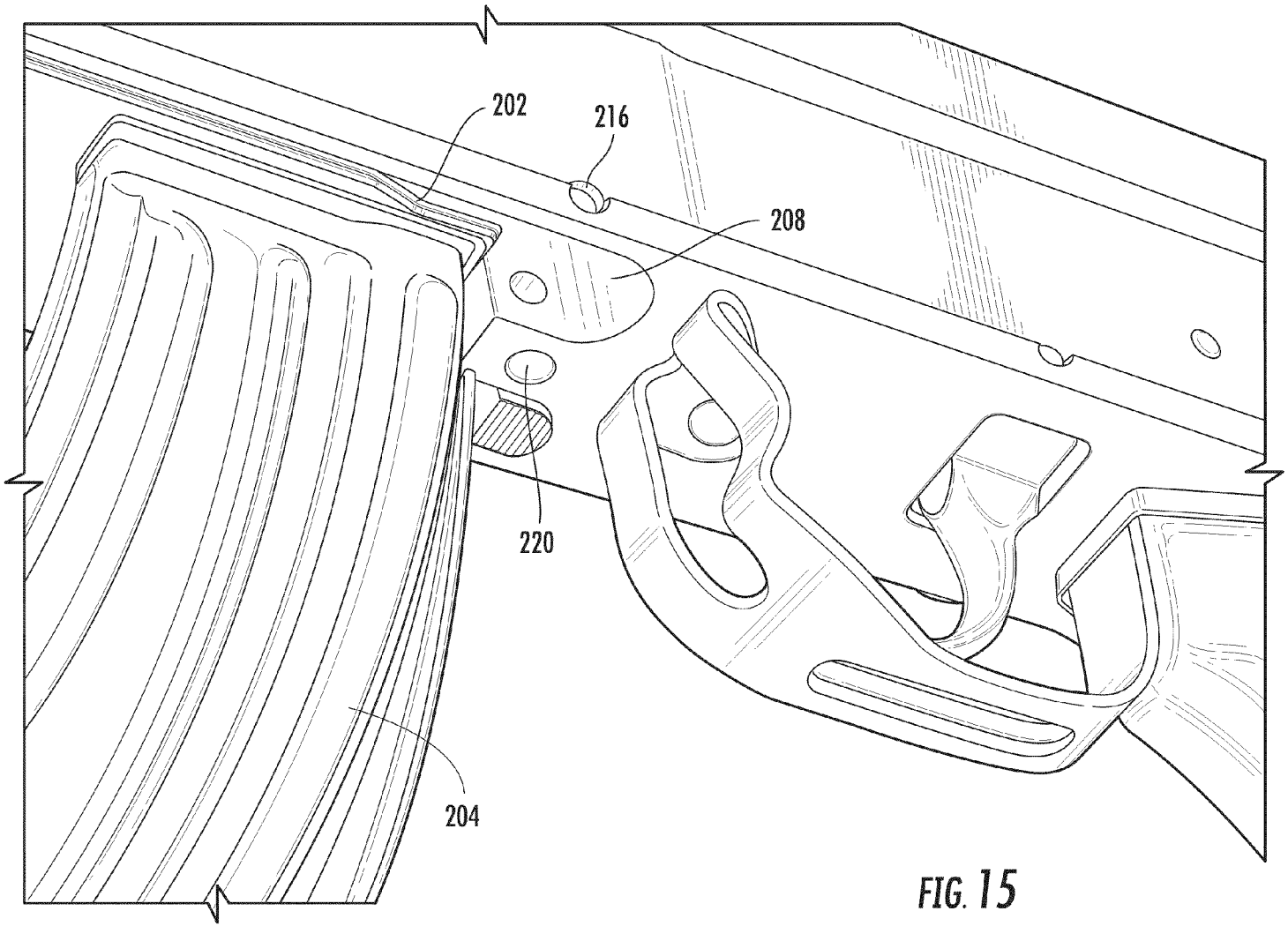
FIG. 15 shows another perspective view of the Sa vzor 58 rifle of FIGS. 12-14 wherein the magazine has been partially placed within the magazine well.

In addition to the various embodiments of apparatuses and kit disclosed above, methods for assembling a modified Sa vzor 58 so that a magazine placed in a clipped position relative to the rifle cannot be detached from the rifle rapidly or, in some cases, at all are disclosed. One embodiment includes the steps of (A) providing an Sa vzor 58 rifle (200, 400) including a magazine well 202 and a groove 208 as described above as shown in FIGS. 12-13; (B) placing the magazine 204 in a clipped position as shown in FIGS. 14-15; (C) inserting the object 100 (or variation thereof) into the groove 208 leading with the distal end 102 of the object 100 such that the engagement end 106 of the object 100 is facing the magazine 204; (D) placing the magazine catch pin 206 through the first rifle catch pin aperture 216, into the passage 114 of the object 100, and over to the second catch pin aperture 218 as shown in FIG. 8; and (E) forcing the magazine safety pin 210 into the magazine safety pin channel 220 as shown in FIG. 9. A rifle assembled using the steps described above is shown, for example, in FIGS. 16-17.

Figure 19:
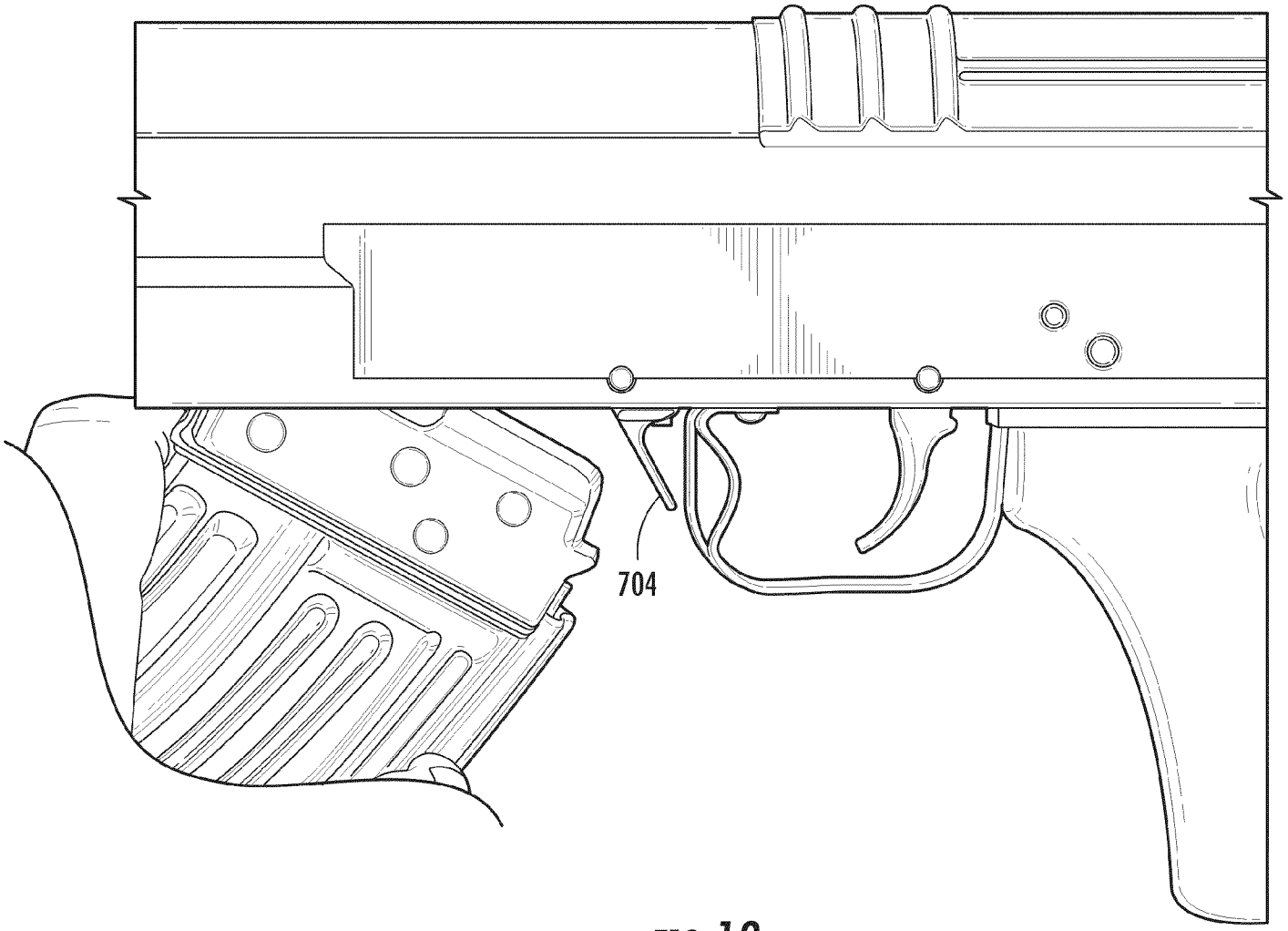
FIG. 19 shows a second step in the removal of a magazine from the magazine well of an Sa vzor 58 rifle by rotating the magazine out of the well beginning with the end closest to the rifle triggering mechanism.
Figure 20:
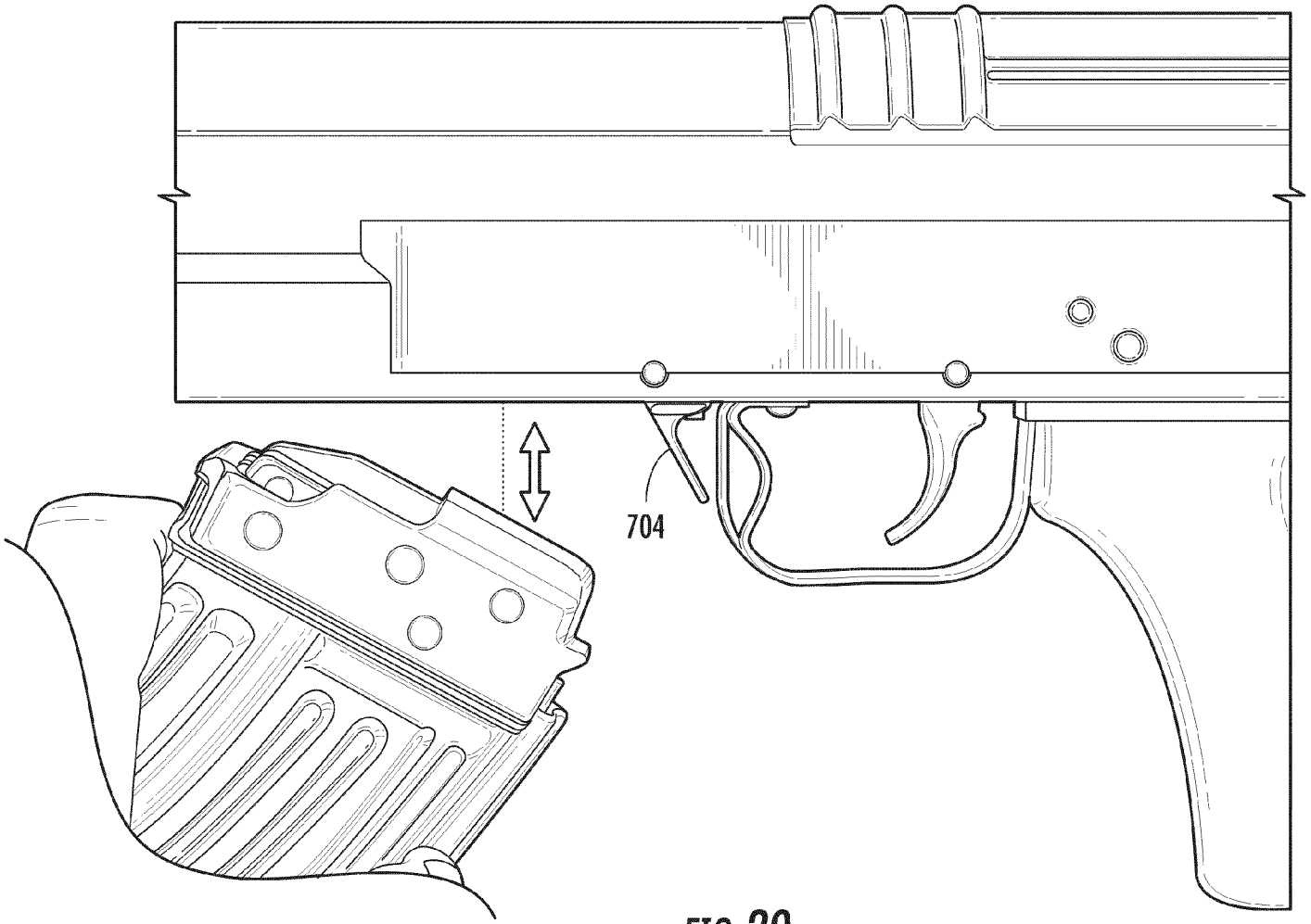
FIG. 20 shows a side view of the Sa vzor 58 rifle of FIGS. 18-19 wherein the magazine has been removed from the rifle.
Figure 21:
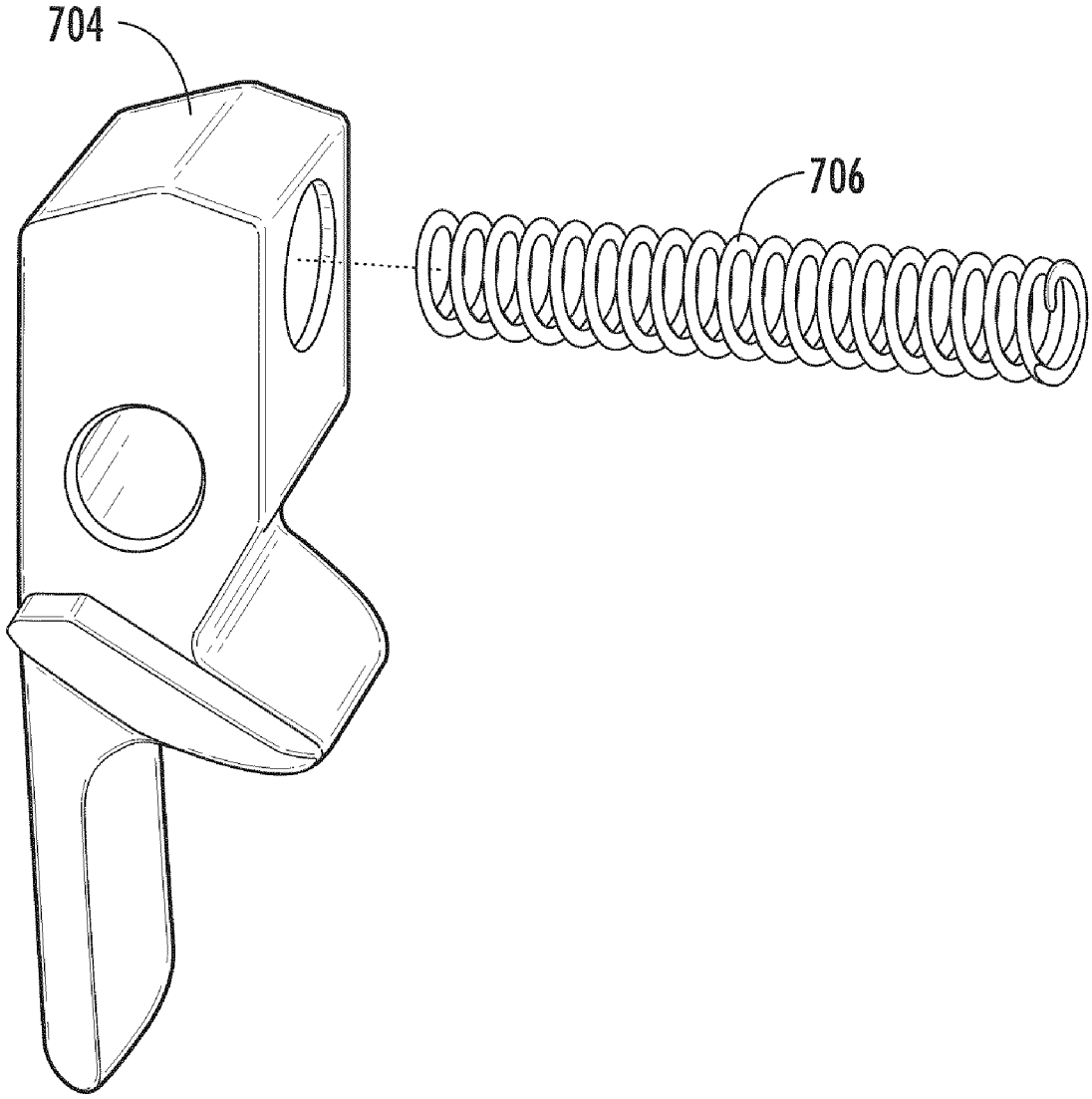
FIG. 21 shows the magazine quick release mechanism used in FIGS. 18-20, the mechanism including a lever and a spring.
Figure 22:
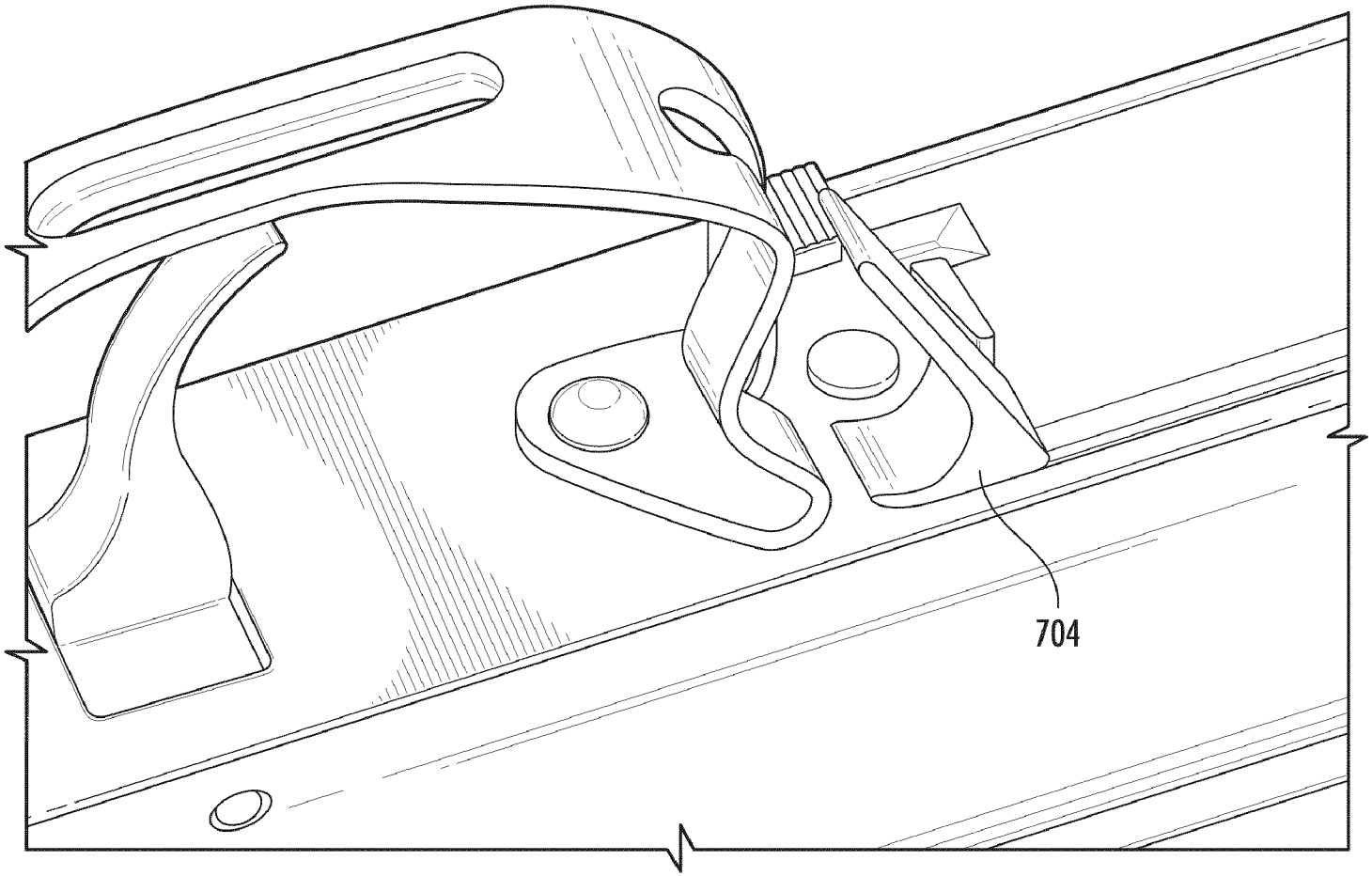
FIG. 22 shows a close-up perspective view of the Sa vzor 58 rifle of FIG. 20.
Figure 23:
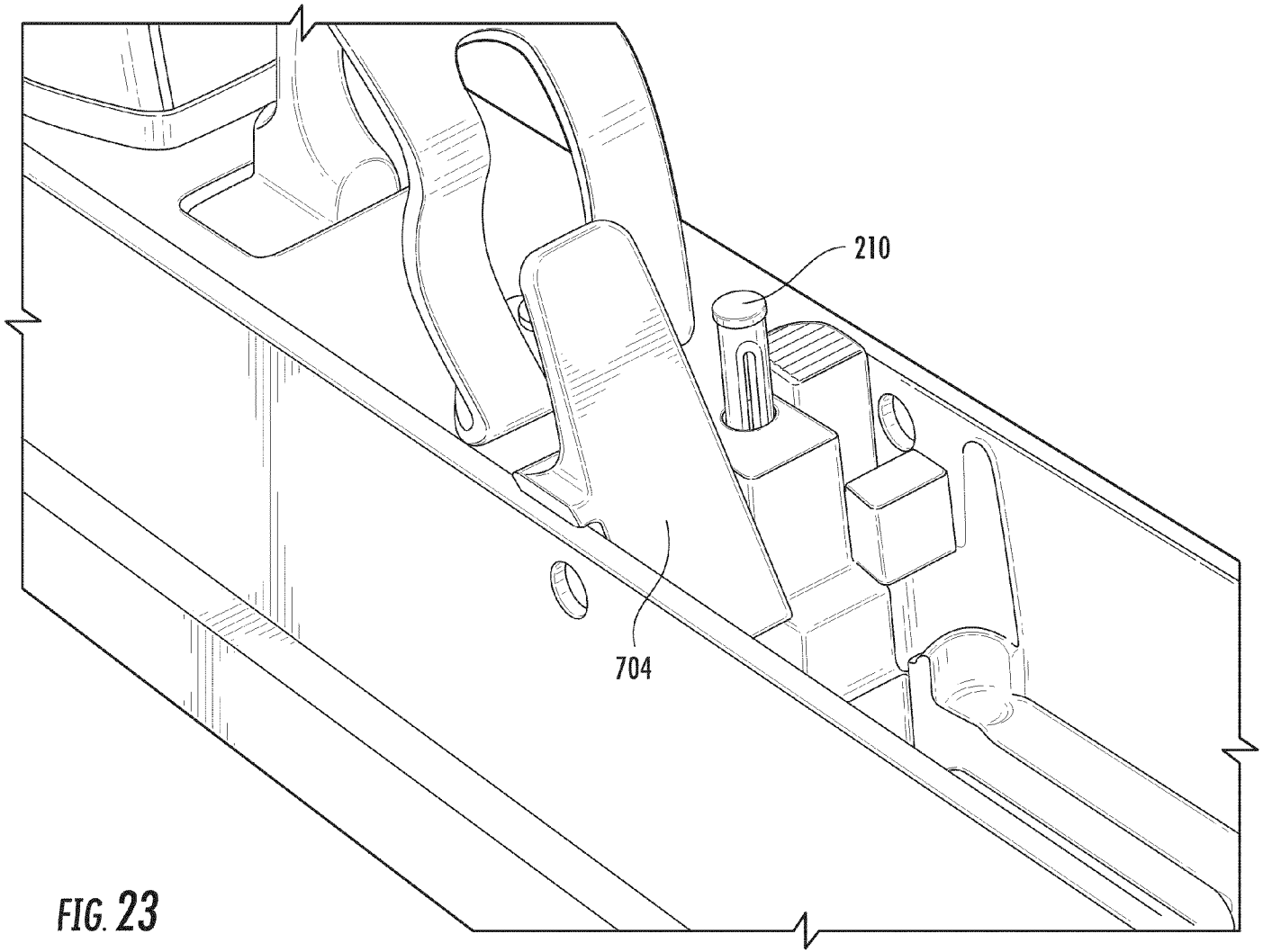
FIG. 23 shows another close-up perspective view of the Sa vzor 58 rifle of FIG. 22 wherein the magazine safety pin is being removed (after a receiver cover has been removed)
Figure 24:
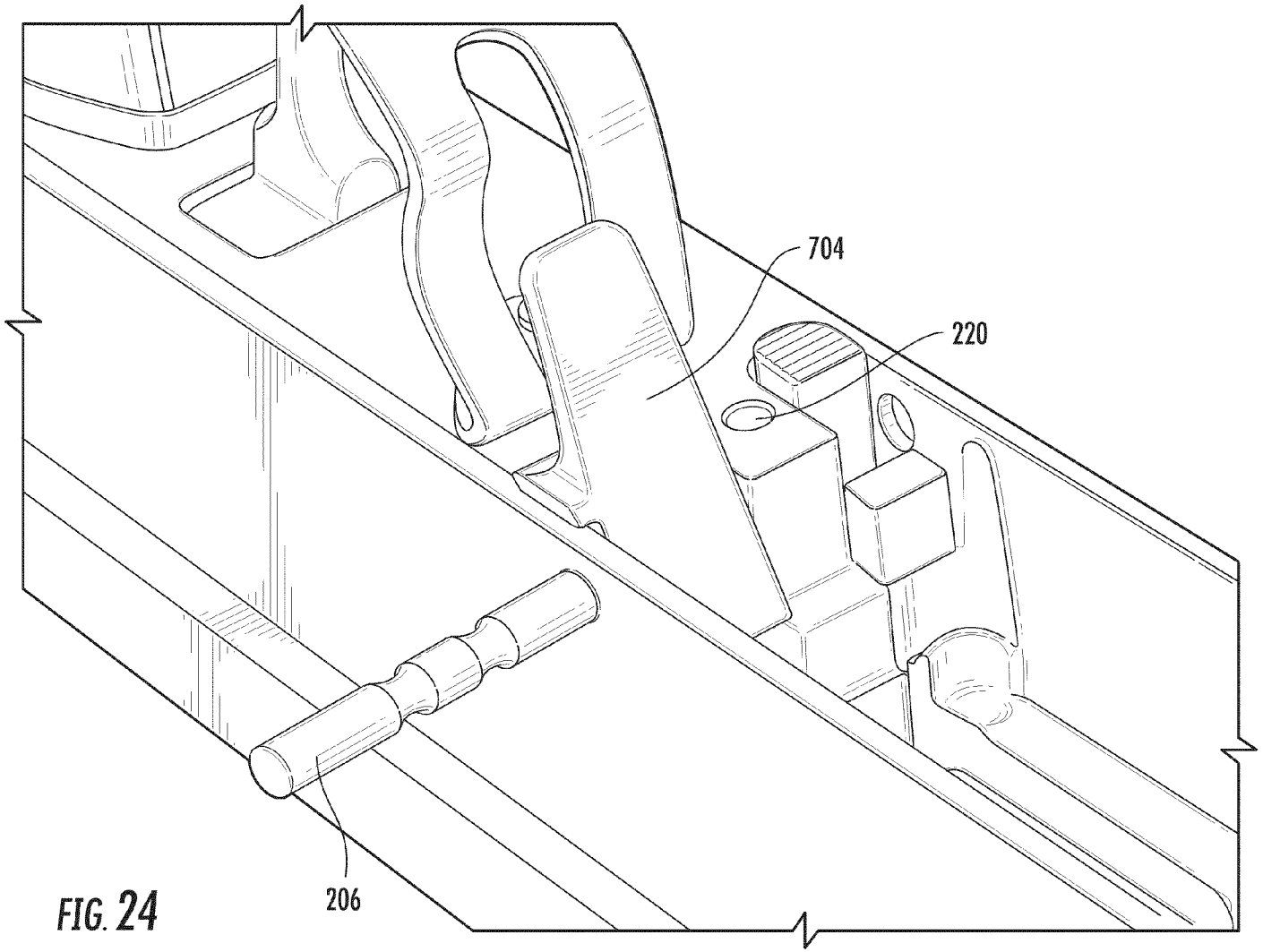
FIG. 24 shows another close-up perspective view of the Sa vzor 58 rifle of FIG. 23 wherein the magazine catch pin is being removed.

In one embodiment, step (A) above further includes the sub-steps of (i) removing the magazine 204 from an Sa vzor 58 rifle 700 as shown in FIGS. 18-20, wherein the rifle 700 is equipped with a quick release mechanism 702 including a lever 704 and a spring 706 (FIG. 21), leaving the rifle 700 with no magazine as shown in FIG. 22; (ii) forcing the magazine safety pin 210 out of the magazine safety pin channel 220 as shown in FIG. 23; (iii) removing the magazine catch pin 206 as shown in FIG. 24; and (iv) removing the quick release mechanism 702 so that an Sa vzor 58 rifle having no attached quick release mechanism is provided prior to step (B).

Figure 16:
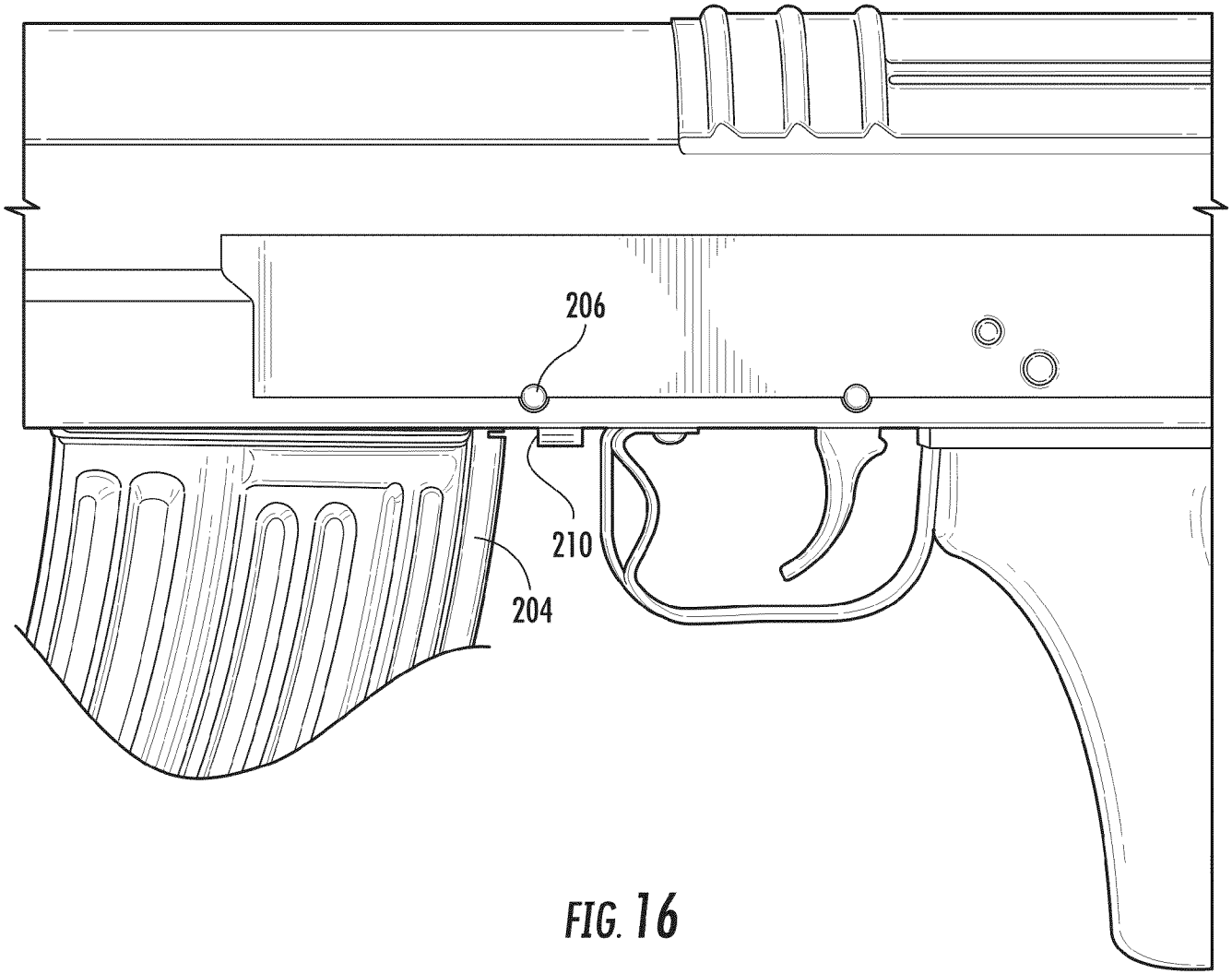
FIG. 16 shows a side view of the Sa vzor 58 rifle of FIGS. 12-15 wherein the apparatus of FIGS. 1A-1G has been placed in the groove of the magazine well, and the magazine catch pin and the magazine safety pin have both been attached to the rifle.
Figure 17:
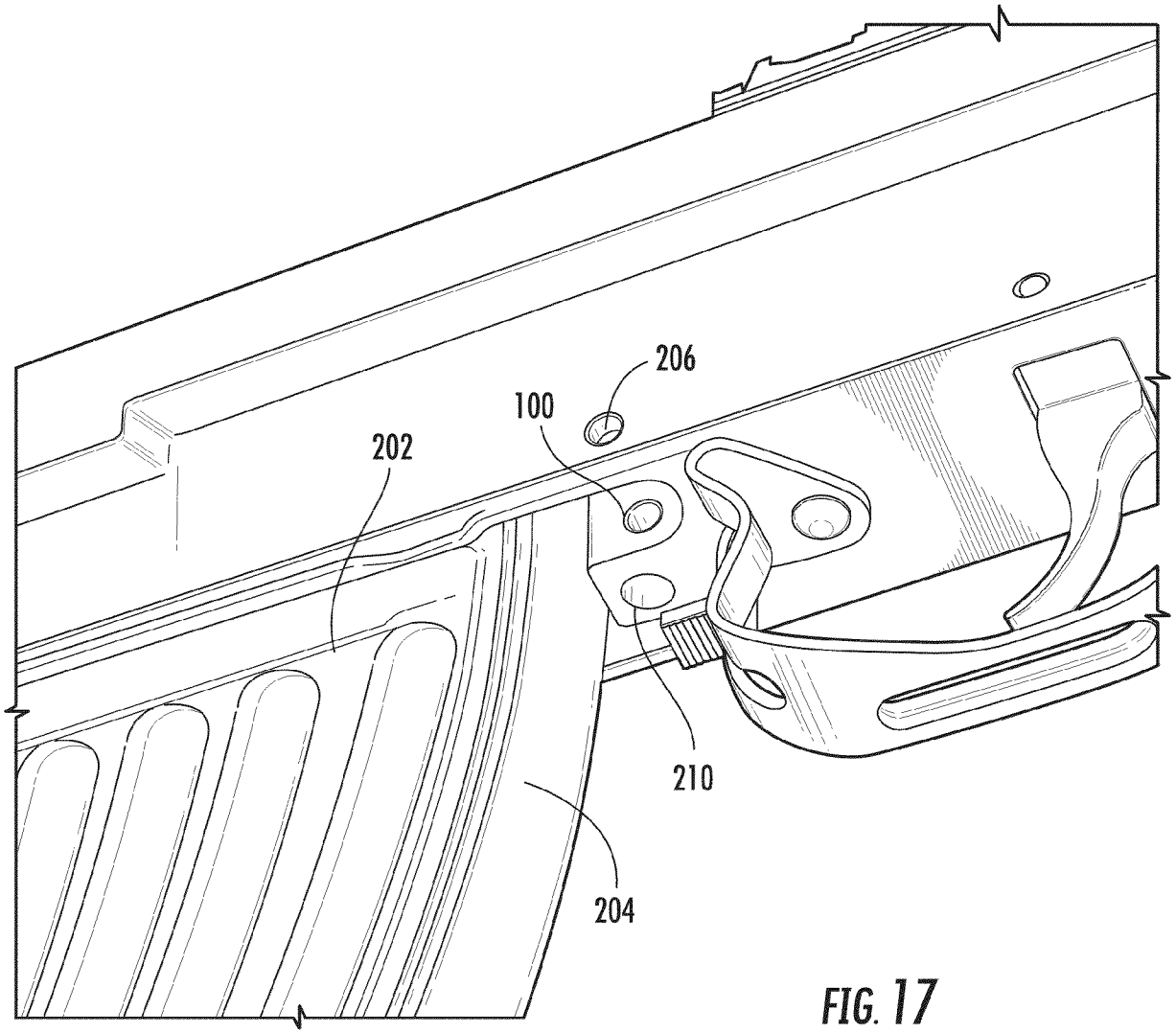
FIG. 17 shows a perspective view of the Sa vzor 58 rifle of FIG. 16.

Another embodiment of a method is disclosed including the steps of (A) providing an Sa vzor 58 rifle (200, 400) including a magazine well 202 including a groove 208 as described above and as shown in FIGS. 13-14; (B) placing the magazine 204 in a clipped position as shown in FIGS. 15-16; (C) inserting the object 100 (or variation thereof including, for example, a version having no passage 114) into the groove 208 leading with the distal end 102 of the object 100 such that the engagement end 106 of the object 100 is facing the magazine 204; and (F) welding the object 100 to one or more of the groove 208 surface(s).

Various embodiments described herein are used to effectively disable/modify the magazine quick release feature of Sa vzor 58 rifles so that such rifles may comply with various national and state laws in the United States.

The previously described embodiments of the present disclosure have many advantages, including providing a relatively inexpensive kit and/or apparatus and relatively simple methods to modify Sa vzor rifles. With regards to certain embodiments described above, in order for the magazine safety pin 210 to be removed, it is necessary for the receiver cover to be removed so that a distal end of the magazine safety pin 222 may be hammered or otherwise manipulated so as to force the magazine safety pin 210 out of the magazine safety pin channel 220. Thus, the magazine 204, when in a clipped position, cannot be removed unless the rifle is substantially disassembled. With regards to the embodiments disclosed wherein the object 100 (or variation thereof) is permanently attached (e.g., welded) to one or more of the groove 208 surface(s), the magazine 204 cannot be removed at all without causing undesirable damage to the rifle. Many current technologies allow a user to use a hand tool to disengage a magazine from a rifle, but these technologies are at the very edge of the law in some jurisdictions and may be nonviable as gun laws fluctuate throughout the United States. Thus, the apparatuses, kits, and methods described herein provide a conservative and viable option to modify Sa vzor 58 rifles or otherwise use a modified Sa vzor 58 rifle with confidence that such use is within the limits of most if not all applicable gun laws in the United States related to firearms.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A modifying apparatus configured to modify a Sa vzor 58 rifle by placing the modifying apparatus at least partially within the magazine well of the rifle so that a magazine placed in a clipped position relative to the rifle cannot be detached from the rifle unless the rifle is substantially disassembled, the modifying apparatus comprising a multifaceted rigid object having a proximal end and a distal end oriented along a first axis and an engagement end and a back end oriented along a second axis, wherein the first axis is substantially orthogonal to the second axis, the object including a maximum length ranging from about 11.5 millimeters (mm) to about 12 mm, a maximum width ranging from about 10.5 mm to about 11 mm, and a height defined by the distance from the proximal end of the object to the distal end of the object.

2. The modifying apparatus of claim 1 further comprising a passage located substantially widthwise through the object, the passage defining a first aperture along a first face of the object and a second aperture along a second face of the object, wherein the passage defines an imaginary central axis which intercepts a first imaginary point at the center of the first aperture and a second imaginary point at the center of the second aperture, wherein the central axis is located a shortest distance ranging from about 9.7 mm to about 10.1 mm from the distal end of the object, a shortest distance ranging from about 8.5 mm to about 8.9 mm from the back end of the object, a longest distance ranging from about 13.0 mm to about 13.4 mm from the distal end of the object, and a longest distance ranging from about 13.0 mm to about 13.4 mm from the back end of the object, the passage configured for receiving at least a portion of a magazine catch pin.

3. A Sa vzor 58 rifle comprising a magazine well including a groove where a quick-release magazine release lever can be located, a magazine oriented in a clipped position within the magazine well, a magazine catch pin, and the modifying apparatus of claim 2 wherein the object is located in the groove such that the distal end of the object is oriented toward the rifle chamber of the rifle, the proximal end of the object is oriented away from the rifle chamber, the engagement end is oriented toward the magazine, and the back end is oriented toward a triggering mechanism, wherein the magazine catch pin is located through a first rifle catch pin aperture, into the passage of the object, and over to a second rifle catch pin aperture.

4. The rifle of claim 3 wherein the magazine is substantially permanently attached to the groove.

5. The rifle of claim 3 further comprising a magazine safety pin wherein the safety pin is located at least partially in a magazine safety pin channel for holding the magazine catch pin in a substantially stationary position relative to the rifle.

6. A Sa vzor 58 rifle comprising a magazine well including a groove where a quick-release magazine release lever can be located, a magazine oriented in a clipped position within the magazine well, and the modifying apparatus of claim 1 wherein the object is located in the groove such that the distal end of the object is oriented toward the rifle chamber of the rifle, the proximal end of the object is oriented away from the rifle chamber, the engagement end of the object is oriented toward the magazine, and the back end of the object is oriented toward a triggering mechanism, wherein the magazine is substantially permanently attached to the groove.

7. The rifle of claim 6 wherein the magazine is substantially permanently attached to the groove by welding a portion of the object to a surface defining a portion of the groove.

* * * * *